US005836714A

United States Patent [19]

Christensen

[11] Patent Number: 5,836,714

[45] Date of Patent: Nov. 17, 1998

[54] CONTROL BARRIER SYSTEMS

[75] Inventor: Marc E. Christensen, Salt Lake City, Utah

[73] Assignee: Off The Wall Production, Inc., Salt Lake City, Utah

[21] Appl. No.: 661,445

[22] Filed: Jun. 11, 1996

Related U.S. Application Data

[63] Continuation-in-part of Ser. No. 533,758, Sep. 26, 1995, Pat. No. 5,611,641, which is a continuation-in-part of Ser. No. 278,495, Jul. 20, 1994, Pat. No. 5,452,963.

[51] Int. Cl.[6] ..... E01F 15/10

[52] U.S. Cl. ..... 404/0.6; 40/611; 40/612; 256/1

[58] Field of Search ..... 404/6, 7; 256/1, 256/13.1; 116/3 P, 63 R; 40/607, 611, 612, 5; 362/812; 5/705, 710, 713, 685

[56] References Cited

U.S. PATENT DOCUMENTS

| | | | |
|---|---|---|---|
| D. 349,738 | 8/1994 | Naegele, III et al. . | |
| 1,049,261 | 12/1912 | Pelissier . | |
| 2,161,193 | 6/1939 | Phillips | 40/612 X |
| 2,794,375 | 6/1957 | Difalco | 404/7 |
| 2,893,148 | 7/1959 | Figman | 362/812 X |
| 2,960,055 | 11/1960 | Tomek . | |
| 3,090,976 | 5/1963 | Liu . | |
| 3,141,655 | 7/1964 | Platt . | |
| 3,284,122 | 11/1966 | Rich . | |
| 3,503,600 | 3/1970 | Rich . | |
| 3,540,699 | 11/1970 | Guzzardella . | |
| 3,572,465 | 3/1971 | Olson . | |
| 3,661,359 | 5/1972 | Walker . | |
| 3,672,657 | 6/1972 | Young et al. . | |
| 3,822,954 | 7/1974 | Ansgariusson | 404/7 |
| 3,856,268 | 12/1974 | Fitch . | |
| 4,138,095 | 2/1979 | Humphrey . | |
| 4,279,105 | 7/1981 | Cameron . | |
| 4,298,186 | 11/1981 | Glass . | |
| 4,348,133 | 9/1982 | Trent et al. . | |
| 4,380,327 | 4/1983 | Fish . | |
| 4,423,854 | 1/1984 | Cobb et al. . | |
| 4,435,106 | 3/1984 | Förster et al. . | |
| 4,500,225 | 2/1985 | Quittner . | |
| 4,624,210 | 11/1986 | Glass . | |

(List continued on next page.)

FOREIGN PATENT DOCUMENTS

| | | | |
|---|---|---|---|
| B-50241/93 | 8/1994 | Australia . | |
| 442249 | 8/1991 | European Pat. Off. | 256/13.1 |
| 2 619 400 | 2/1989 | France . | |
| 2660945 | 10/1991 | France | 256/13.1 |
| 2 663 657 | 12/1991 | France . | |
| 2 743 825 | 7/1997 | France . | |
| 1658470 | 10/1970 | Germany | 404/7 |
| 942255 | 11/1963 | United Kingdom | 404/7 |
| 1 482 634 | 8/1977 | United Kingdom . | |
| 2 084 635 | 4/1982 | United Kingdom . | |
| 2219332 | 12/1989 | United Kingdom | 256/13.1 |
| 2 237 832 | 5/1991 | United Kingdom . | |
| 2 282 836 | 4/1996 | United Kingdom . | |

*Primary Examiner*—James Lisehora
*Attorney, Agent, or Firm*—Workman, Nydegger & Seeley

[57] ABSTRACT

Portable control barriers for use in sporting or entertainment events having a lightweight housing formed of a resiliently deformable material. Each housing has an interior surface defining an internal chamber that can be selectively filled with a ballast. In one embodiment, the housing has opposing end walls, opposing sidewalls, and a substantially flat bottom wall. A spline and groove are each positioned on one of the opposing end walls. The spline and groove are configured to interlock adjacently positioned barriers. In yet another embodiment, a spout and receiving aperture are positioned on opposing end walls. In this embodiment, the spout of one barrier can be received in sealed fluid communication with the receiving port of an adjacent barrier, thereby allowing fluid communication of the ballast between adjacent barriers. Finally, in yet another embodiment, the bottom wall of the housing can be arched so as to form a passageway extending through the barrier. The bottom wall has a surface that is complementary to the top surface of the housing so that a plurality of barriers can be nestably stacked.

41 Claims, 15 Drawing Sheets

U.S. PATENT DOCUMENTS

| | | | |
|---|---|---|---|
| 4,665,673 | 5/1987 | Diana . | |
| 4,681,302 | 7/1987 | Thompson | 256/13.1 |
| 4,773,629 | 9/1988 | Yodock | 256/13.1 |
| 4,796,369 | 1/1989 | Hamann | 116/63 P X |
| 4,854,767 | 8/1989 | Sasaki | 404/6 |
| 4,869,617 | 9/1989 | Chiodo | 404/6 |
| 4,925,333 | 5/1990 | Bishop . | |
| 4,943,035 | 7/1990 | Thompson et al. . | |
| 4,944,060 | 7/1990 | Peery et al. | 5/713 |
| 4,946,306 | 8/1990 | Yodock . | |
| 4,974,815 | 12/1990 | Glass | 404/6 X |
| 4,978,245 | 12/1990 | White . | |
| 5,011,325 | 4/1991 | Antonioli . | |
| 5,106,554 | 4/1992 | Drews . | |
| 5,122,008 | 6/1992 | Drews . | |
| 5,123,773 | 6/1992 | Yodock | 404/6 |
| 5,208,585 | 5/1993 | Spague | 404/6 X |
| 5,213,312 | 5/1993 | MacDonald . | |
| 5,269,623 | 12/1993 | Hanson . | |
| 5,387,049 | 2/1995 | Duckett | 404/6 |
| 5,412,381 | 5/1995 | Dicks | 304/908.1 |
| 5,452,963 | 9/1995 | Christensen | 404/6 |
| 5,460,353 | 10/1995 | Rittenhouse . | |
| 5,467,548 | 11/1995 | Ross | 40/612 |
| 5,498,101 | 3/1996 | Braverman . | |
| 5,611,641 | 3/1997 | Christensen | 256/1 X |
| 5,634,225 | 6/1997 | Miller, Jr. et al. | 5/710 |
| 5,639,179 | 6/1997 | Jensen | 404/6 |

CONTROL BARRIER SYSTEMS

BACKGROUND OF THE INVENTION

1. Related Applications

This application is a continuation-in-part of U.S. patent application Ser. No. 08/533,738 filed Sep. 26, 1995 for "IMPROVED CROWD CONTROL BARRIER SYSTEM" by Marc E. Christensen, now U.S. Pat. No. 5,611,641, which is a continuation-in-part of 08/278,495, filed on JUl. 20, 1994 now U.S. Pat. No. 5,452,963, entitled "CROWD CONTROL BARRIER," which issued Sep. 26, 1995 in the name of Marc E. Christensen. For the purpose of disclosure for the present application, the above identified references are incorporated herein by reference.

2. The Field of the Invention

The present invention relates to portable, reusable, control barriers, and more particularly, barrier systems for use with activities such as athletic events which require a temporary, predefined field layout or for use with entertainment events having a stage where a discreet distance between spectators and the stage is desired to be maintained.

3. The Relevant Technology

Control barriers are used in a variety of situations. For example, control barriers can be selectively positioned at special events, such as parades, to help direct people in a desired direction. Alternatively control barriers can be put up to help limit access to select areas. In yet other embodiments, control barriers can be put up to define an entertainment stage or the boundaries of a playing field. For example, control barriers can be used to define the boundaries of a soccer field or an ice skating rink.

Conventional control barriers have long comprised individual sawhorse type barriers or collapsible V-shape barricades. Such barriers, however, have limited use since they are generally lightweight and easily tipped over. This can be a problem when large crowds are encountered or when the barriers are being used on a playing field where they might get bumped. Furthermore, such barriers are typically not connected and often have spaces or gaps extending therethrough. As such, it is possible for individuals to either slip between or through the barriers.

Other barriers comprise various gates or walls which are constructed. Such barriers, however, require extensive time to assemble and disassemble. In yet other alternative embodiments, concrete barriers have been used. Although such barriers are not easily tipped over, such barriers are extremely heavy. As such, they are difficult to move and place in desired locations. Often, special equipment such as fork lifts or cranes are required. Furthermore, concrete barriers can be both difficult and expensive to move over large distances and require a large area to store. Finally, concrete barriers can be dangerous in that they are rigid and non-forgiving when impacted by a person.

SUMMARY AND OBJECTS OF THE INVENTION

It is an object of this invention to provide improved control barriers which are relatively light in weight for ease of transportation yet may be ballasted after positioning to provide a heavier barrier.

It is another object of the present invention to provide improved control barriers that have sufficient weight to prevent being knocked over or pushed aside by bearing crowds.

Yet another object of the present invention is to provide control barriers having sufficient height to control access to a defined area while permitting a spectator to view the defined area.

It is another object of the present invention to provide control barriers which may be easily positioned in the desired configuration and selectively locked into place.

Also, another object of the present invention is to provide control barriers which will yield slightly upon impact to lessen the damage to an object or individual colliding with the barrier.

It is a further object of the present invention to provide a barrier system which may be easily unballasted and reused.

It is also an object of the present invention to provide improved control barriers that can be moved by hand.

Still another object of the present invention is to provide improved control barriers that can be stored in relatively small areas.

Finally, it is yet another object of the present invention to provide improved control barriers that are reusable.

The above objects are provided by the control barriers of the present invention which comprise a portable elongated housing formed from a resiliently deformable semi-rigid material. The housing has an exterior surface and an interior surface. The interior surface defines an internal chamber that can be filled with a ballast such as water. The housing further comprises a first sidewall having a bottom edge for resting on a ground surface and an opposing top portion. Likewise, the housing includes a second sidewall having a bottom edge resting on a ground surface and an opposing top portion, the top portion of the first sidewall and the second sidewall being connected. Furthermore, a bottom wall extends between the bottom edges of the first sidewall and the second sidewall. In one embodiment, the bottom wall is substantially flat. In an alternative embodiment the bottom wall is arched so that a passageway extends through the housing. Where the bottom wall is arched, the bottom wall has a bottom surface that is complementarily configured to the top surface of the housing. In this manner, a plurality of barriers can be nestably stacked by receiving the bottom surface of one barrier on the top surface of another barrier.

In another embodiment, the barriers have opposing end walls. A spline projects from one of the end walls while the opposing end wall has a groove that is complementary to the shape of the spline. In this configuration, the spline of one barrier can be received within the groove of an adjacent barrier. As the ballast is inserted within the internal chamber of the barriers, the spline radially expands while the groove constricts so as to form a mechanical interconnection.

In yet another embodiment, a spout projects from one of the end walls. The spout has a passageway extending therethrough and being in fluid communication with the internal chamber of the barrier. The opposing end wall has a receiving port that is also in fluid communication with the internal chamber of the barrier. In this manner, a spout from one barrier can be connected in fluid communication with the receiving port of an adjacent barrier. In this embodiment, fluid filled within one of the barriers flows into the adjacent barrier through the fluid spout so as to simultaneously fill each of the barriers.

In one embodiment, the present invention also provides for a display recess to be formed on one of the sidewalls of the barrier. A display, such as an advertising sign, can be positioned within the display recess so as to be substantially flush with the top surface of the barrier. The display can be a conventional sign or a programmable LCD screen. In yet another embodiment, the display can be light permeable and fluorescent lights can be positioned behind the light permeable display for illumination thereof.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
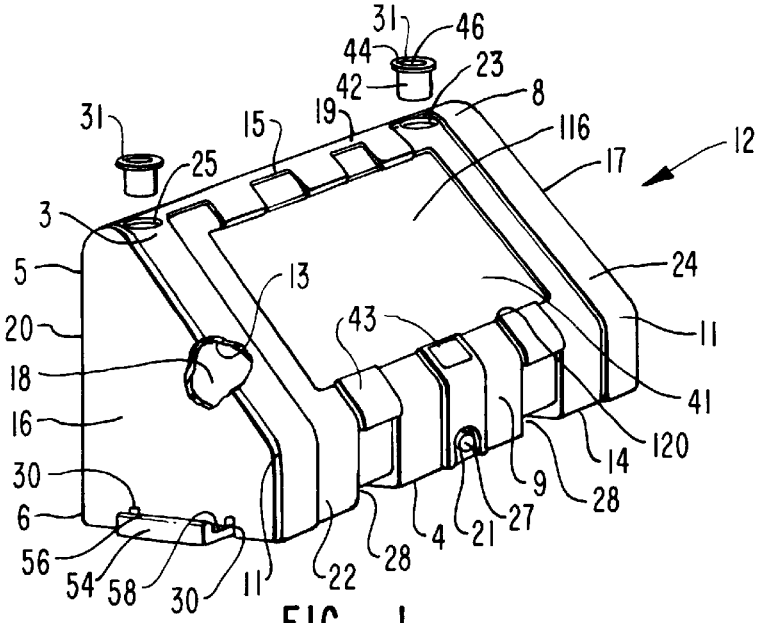
FIG. 1 is a perspective view of one embodiment the crowd control barrier of the present invention.

Referring now to FIG. 1, a straight control barrier 12 is disclosed as comprising an elongated housing 19 having an exterior surface 15. Exterior surface 15 is defined in part by opposing sidewalls 20 and 22, opposing end walls 16 and 17, and a substantially flat bottom wall 14. Sidewall 20 comprises a bottom edge 6 for resting on a ground surface and an opposing top portion 5. In like manner, sidewall 22 is shown as comprising a bottom edge 4 and a top portion 3. Sidewall 22 further comprises a base portion 9 that rises initially vertically to an outside corner 11 and then transitions into an intermediate wall portion 24. Wall portion 24 slopes radially inward from the corner 11 and terminates at a curved top juncture 8 that connects top portion 5 of sidewall 20 and top portion 3 of sidewall 22. As will be discussed later in greater detail, formed on portion 24 is a display recess 41.

As also depicted in FIG. 1, barrier 12 comprises an interior surface 13 defining an internal chamber 18. Positioned near end wall 16 and extending through junction 8 so as to communicate with chamber 18 is an fill hole 25. In one use, fill hole 25 comprises a means for filling the internal chamber with a ballast. By way of example and not by limitation, the ballast can include sand, water, or other types of liquids, for keeping barrier 12 in a desired location. In alternative embodiment, fill hole 25 can of course be positioned at other locations such as sidewalls 20 and 22 or end walls 16 and 17. A plurality of support ribs 43 are also formed on sidewall 22. Ribs 43 help to prevent the deformation of sidewall 22 as ballast is filled within chamber 18. As such, displays positioned within recess 41 are not substantially deformed.

The present invention also provides means for draining the ballast from internal chamber 18 when it is desired to relocate or reposition barrier 12. As depicted in FIG. 1, the draining means can comprise a drain hole 21 extending through base portion 9 and communicating with chamber 18. A drain plug 27, preferably recessed within housing 19, selectively seals off the drain hole 21. In alternative embodiments, drain hole 21 can be positioned in different locations, although preferably near bottom wall 14. Furthermore, it is noted that fill hole 25 used to fill chamber 18 can also be used as the drain means. For example, the ballast can be pumped out of fill hole 25 or barrier 12 can be tipped so that the ballast flows out of fill hole 25.

A second fill hole 23 is positioned near end wall 17 and extends through junction 8. Fill hole 23 can be used for the same purpose as fill hole 25. FIG. 1 also discloses a cylindrical plug 31 having a base 42 sized to be received within fill hole 23 and an enlarged annular flange 44 radially extending out from plug 31. Flange 44 is sized to rest on junction 8 when base 42 is received within hole 23. A recess 46 extends though flange 44 and into plug 31. A separate plug 31 can also be received within fill hole 25 so that flange 44 is biased against junction 8. The function of plug 31 is further discussed below.

Figure 2:
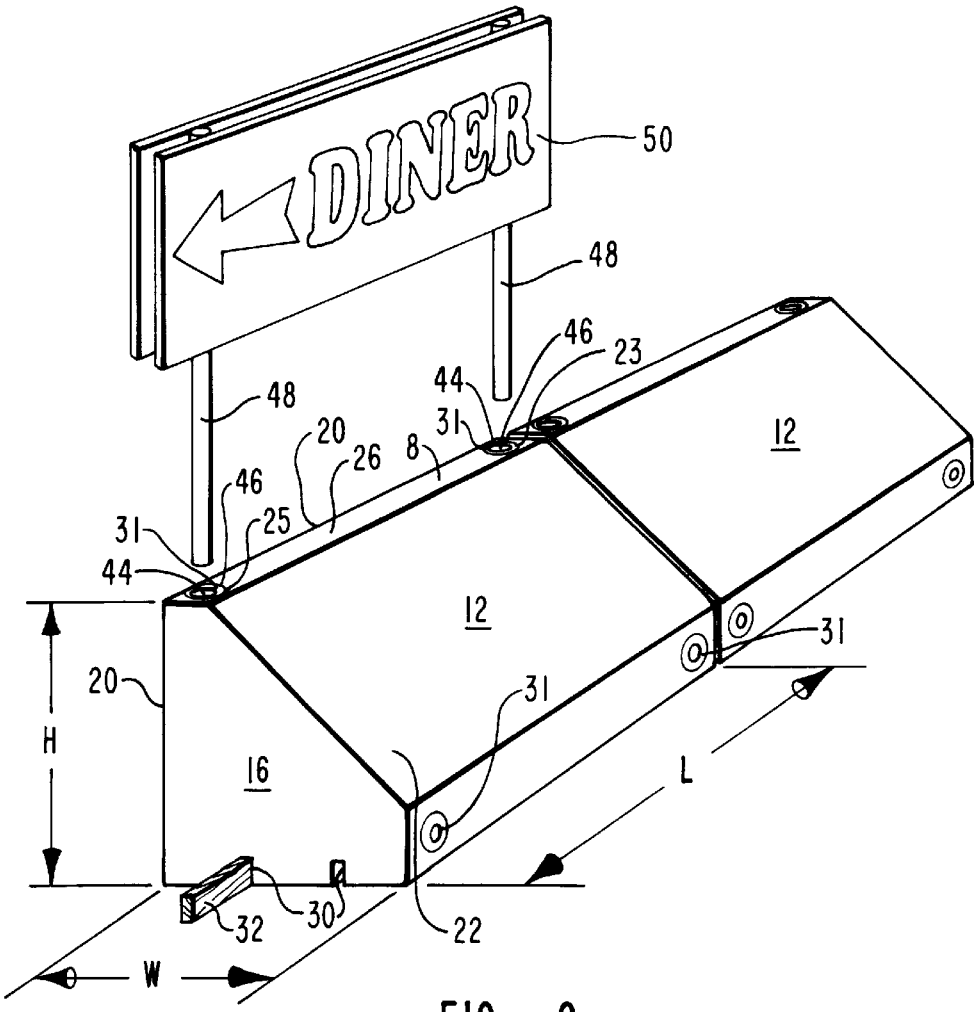
FIG. 2 is a perspective view of an alternative embodiment of a crow control barrier showing a display vertically projecting therefrom.

FIG. 2 discloses an alternative embodiment of barrier 12. As depicted in FIG. 2, junction 8 comprises a flat top wall 26 connecting sidewalls 20 and 22. Furthermore, barrier 12 is shown as comprising a pair of drain plugs 31 positioned near opposing ends near barrier 12.

The present invention also provides means for extending the height of barrier 12. By way of example and not limitation, plug 31 is received within both of fill holes 23 and 25 so that flanges 44 rest on top wall 26. Poles 48 can then be received within each of recesses 46 to support poles 48 in a vertical orientation. Finally, a cross member 50 can be supported between poles 48. Cross member 50 can comprise any one of a number of structures such as signs, netting, displays, or the like.

As also depicted in FIG. 2, barrier 12 preferably has a length "L" in a range between about 4 feet to about 7 feet, a width "W" in a range between about 3 feet to about 5 feet, and a height "H" in a range between about 3 feet to about 5 feet. In the preferred embodiment, height H of barrier 12 is greater than the height of the hip of 90 percent of the population. As such, height H is preferably in a range between about 3.5 feet to about 4.0 feet. The preferred height helps to preclude the majority of the population from easily stepping or crossing over barrier 12.

The dimensions of barrier 12 can vary based on the intended use of barrier 12. In the preferred embodiment, however, the dimensions are such that barrier 12 has a weight in a range between about 40 pounds to about 60 pounds when barrier 12 is absent of any ballast. Such a weight range allows barrier 12 to be easily moved by hand by a single individual.

Barrier 12 is preferably made by a rotational molding process. Alternatively, other molding processes such as injection molding can also be used. Furthermore, barrier 12 is preferably made of a resiliently deformable plastic material having strong, semi-rigid and energy absorbing properties. Such materials include linear or cross link-plastics, preferably polyethylene. The materials are selected from a polymeric group which will deform under internal pressure but will not fail in a brittle manner. If applicable, the material can also be selected so that exterior surface 15 can be substantially smooth to reduce abrasions from collisions of players or crowds pushing against barrier 12.

As used in the specification and appended claims, the term "semi-rigid" is defined to mean that barrier 12 may be made from a material that is capable of allowing a slight flexing when a ballast, such as water, is introduced into chamber 18. Although barrier 12 may be constructed of a rigid material which would hold its shape regardless of the interior loading of the ballast, the preferred embodiment utilizes a semi-rigid material. As will be disclosed later, the flexure of barrier 12 is useful to the locking mechanism by which barriers 12 are connected.

Figure 3A:
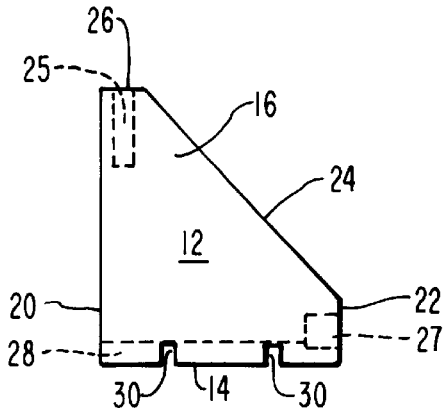
FIG. 3A is an elevated side view of the crowd control barrier in FIG. 2.
Figure 3B:
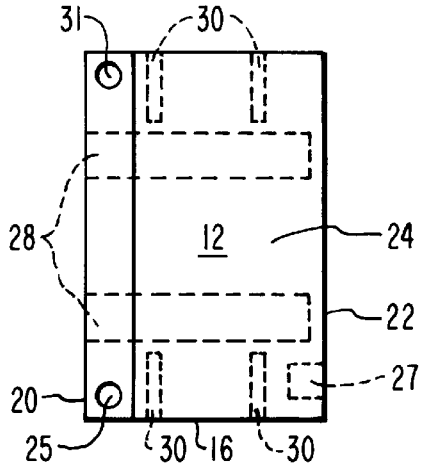
FIG. 3B is a top plan view showing hidden lines of the crowd control barrier of FIG. 2.
Figure 3C:
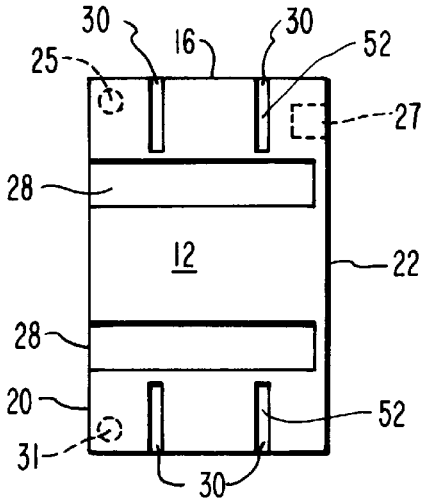
FIG. 3C is a bottom plan view of the crowd control barrier shown in FIG. 2.

Referring again to FIG. 1, a pair of parallel transport slots 28 extend through sidewall 22 of barrier 12 and are recessed within bottom wall 14 a predetermined distance toward sidewall 20. In an alternative embodiment, as shown in FIGS. 3B and 3C, transport slots 28 can extend through sidewall 20 a predetermined distance toward sidewall 22. Likewise, slots 28 may extend through both sidewalls 20 and 22 to allow access from either side. Slots 28 are dimensioned and spaced apart in order to receive the tines of a standard fork lift for ease in moving and transporting barriers 12. By the use of slots 28, barrier 12 may even be moved when chamber 18 is filled with a ballast.

The location of transport slots 28 in part depends on the type of activity for which barrier 12 is utilized. For example, if barrier 12 is utilized to delimit a playing field for a game, such as hockey which has a relatively small game piece, slots 28 will be formed on the sidewall opposite the sidewall defining the inside of the playing surface. This will result in the inside sidewall being solid which prevents the game piece from traveling into slots 28. Where, however, the playing piece used is large, such as in the case of soccer, or where barrier 12 is used as a barrier for crowd control at an enterprise where no game pieces are 11 utilized, the embodiment wherein transport slots 29 extend completely transversely through barrier 12 would be acceptable.

The present invention also provides means for mechanically interconnecting end walls 16 and 17 of adjacent barriers 12 so that the strength of the connection increases as internal chamber 18 of barriers 12 are filled with ballast. By way of example and not by limitation, as also depicted in FIGS. 3A–3C, barrier 12 further comprises a pair of spaced parallel slots 30 recessed within bottom wall 14 and extending through end wall 16. A comparable pair of parallel slots 30 are likewise recessed within bottom wall 14 and extend through end wall 17. Slots 30 are defined in part by interior surfaces 52. Slots 30 are further positioned so that when end walls 16 and 17 of adjacent barriers 12 are abutted, such as disclosed in FIG. 2, the slots 30 on each of barriers 12 are aligned.

Slots 30 are dimensioned to snugly receive a structural member 32, as also shown in FIG. 2. For convenience, structural member 32 is preferably a standard 2"×4" wood stud. Alternatively, other sized boards or members made from other material can be used as long as structural member 32 and corresponding slots 30 are correspondingly sized. More specifically, structural member 32 preferably has a length and cross section that enables structural member 32 to be snugly received within both slots 30 when opposing end walls 16 and 17 of a pair of barriers 12 are abutted against each other.

In practice, barrier 12, while empty of any ballast material is transported to a site where it is to be used. Barrier 12 may then be placed or otherwise positioned in the desired layout at the location where barrier 12 is needed. As barrier 12 is being positioned, structural member 32 is placed such that when end wall 16 of a first barrier 12 is positioned against end wall 17 of a second barrier 12, slots 30 in the abutting barriers 12 completely receive member 32. Once positioned, liquid or other ballast is introduced into internal chamber 18 of each barrier 12.

Figure 4A:
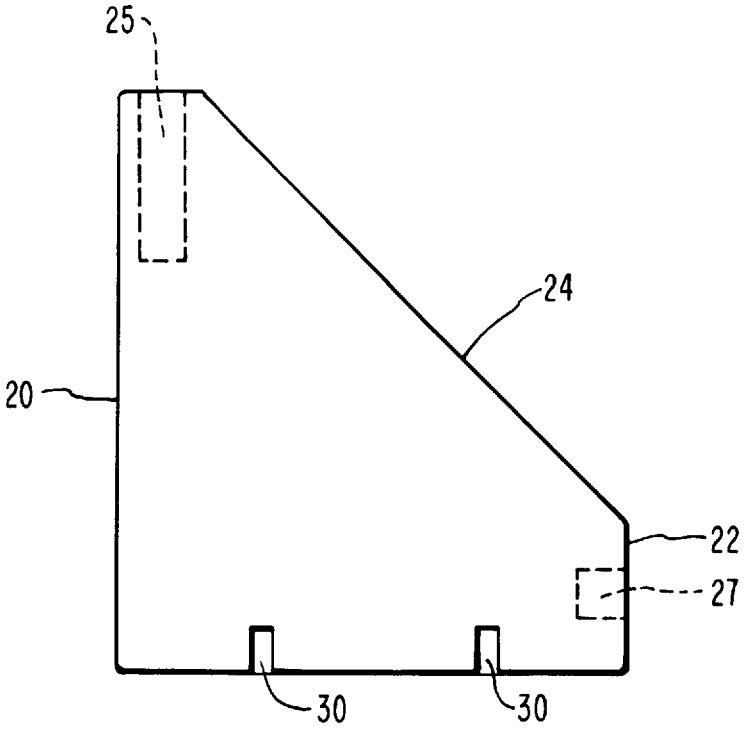
FIG. 4A is an elevated side view of the crowd control barrier in FIG. 2 prior to receiving ballast.
Figure 4B:
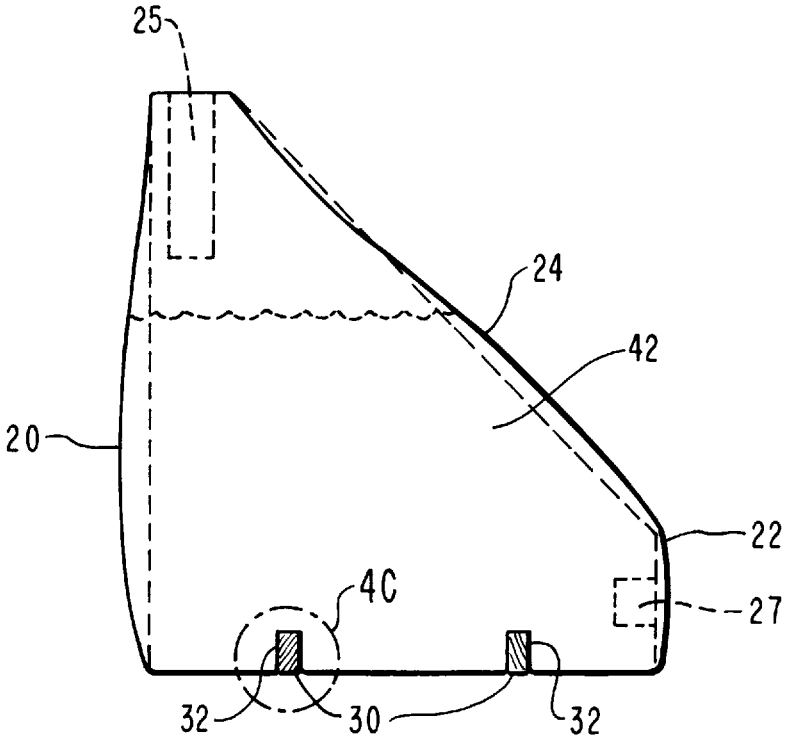
FIG. 4B is an elevated side view of the crowd control barrier shown in FIG. 4A after receiving ballast.
Figure 4C:
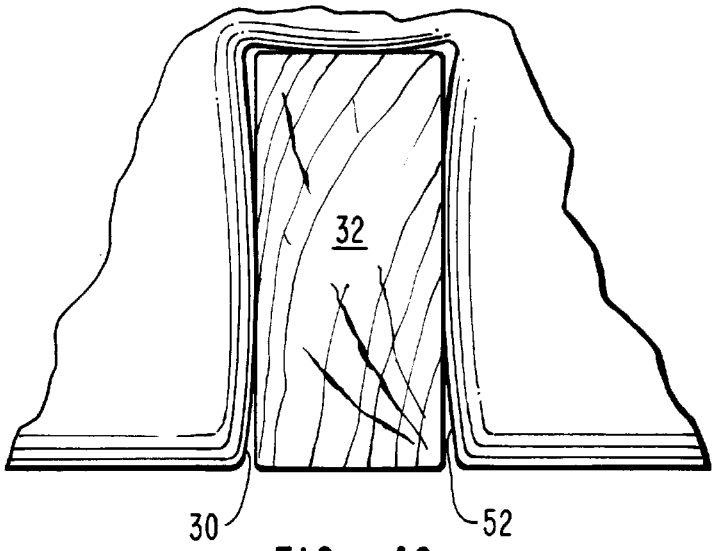
FIG. 4C is an enlarged side view of the crowd control barrier in FIG. 4B crimping a structural member.

Referring now to FIGS. 4A–4C, barrier 12 is shown prior to, during, and after the introduction of ballast into chamber 18. In the empty state, shown in FIG. 4A, control barrier 12 may be easily moved and positioned into a desired configuration. Referring to FIG. 4B, as ballast 42, such as water, is introduced into chamber 18, the weight of the ballast 42 causes a slight flexure in sidewalls 20 and 22. As the pressure increases, interior surface 52 of slots 30 radially bow inward, thereby clamping firmly onto member 32, as shown in FIG. 3C. The ballast thus not only adds weight to barrier 12 to help hold barrier 12 in place, but also clamps barrier 12 onto member 32 so as to rigidly interlock adjacent barriers 12. As a result, the normal force of a crowd pushing against barrier 12 or of a player running into barrier 12 would not be sufficient to dislodge two contiguous barriers 12 from their positions.

Figure 5:
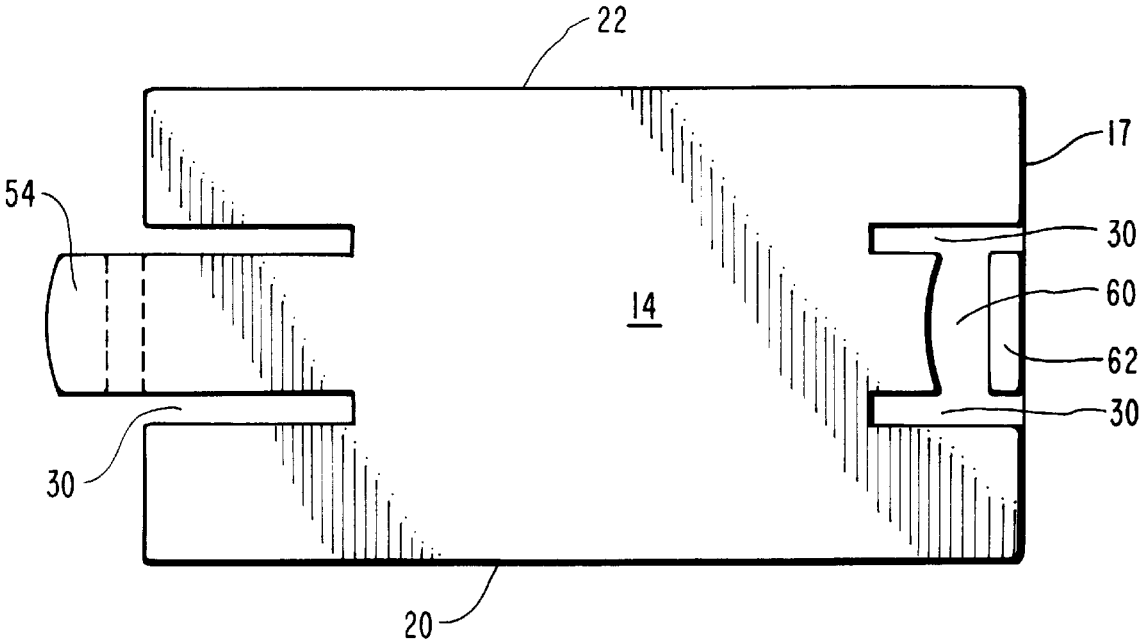
FIG. 5 is a bottom plan view of the embodiment of a barrier shown in FIG. 1.

In an alternative embodiment of the means for mechanically interconnecting end walls 16 and 17, FIG. 1 discloses a tongue 54 projecting from end wall 16 between slots 30 at bottom wall 14. Tongue 54 terminates at a vertical ridge 56 defining a groove 58 formed between ridge 56 and end wall 16. Furthermore, as best shown in FIGS. 5, bottom wall 14 has a receiving groove 60 recessed within bottom wall 14 and extending between slots 30 at end wall 17. Receiving groove 60 is configured to complementarily receive ridge 56 on tongue 54. Formed between groove 60 and sidewall 17 is a ridge 62. Ridge 62 is not flush with bottom 14. Rather, ridge 62 is recessed such that as end walls 16 and 17 of adjacent barriers 12 are abutted against each other, ridge 56 of tongue 54 is received within groove 60 as ridge 62 is received within groove 58 of tongue 54. In this position, bottom wall 14 of both barriers remain flush on the ground surface. As ballast is received within barrier 12, barrier 12 flexes to cause the interior surface of groove 60 to clamp against ridge 56. Tongue 54 and groove 60 can be used independently or in conjunction with slots 30 and structural member 32.

Figure 6A:
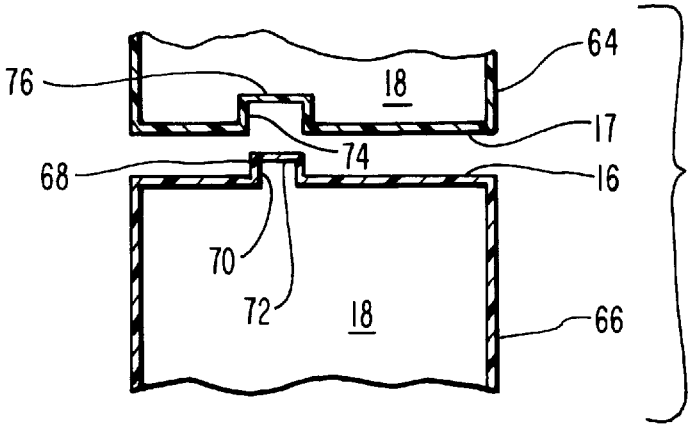
FIG. 6A is a cross-sectional view of adjacent barriers having a spline and groove.
Figure 6B:
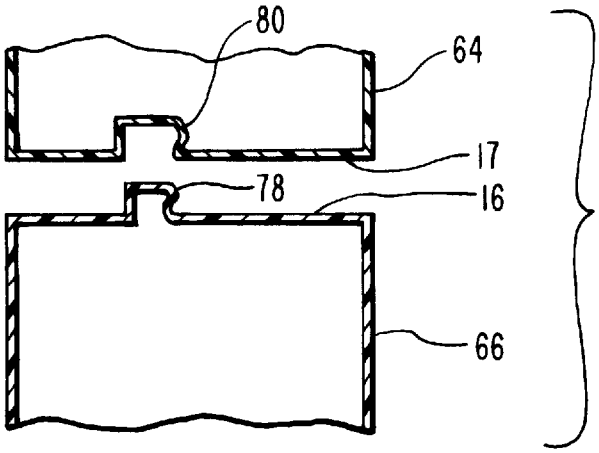
FIG. 6B is a cross-sectional view of adjacent barriers having an L-shaped spline and groove.
Figure 6C:
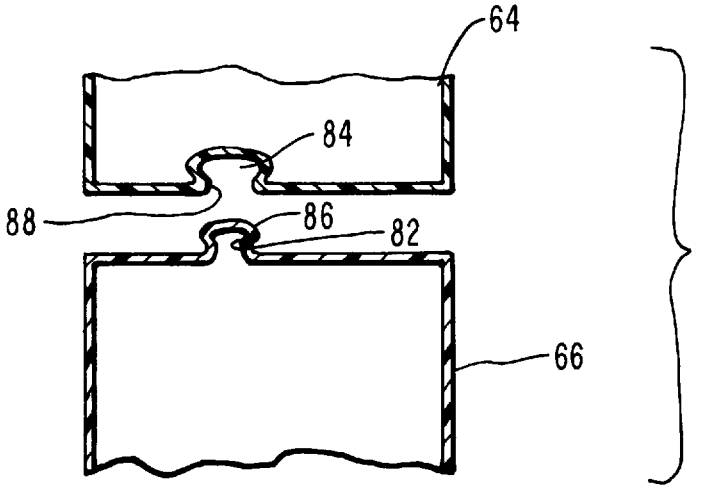
FIG. 6C is a cross-sectional view of adjacent barriers having a T-shaped spline and groove.

Turning now to FIGS. 6A–6C, yet another alternative embodiment of the means for mechanically interconnecting end walls 16 and 17 of adjacent barriers is disclosed. FIG. 6A is a cross-sectional view of a first barrier 64 having an end wall 17 positioned adjacent to a second barrier 66 having an end wall 16. Second barrier 66 includes a rectangular spline 68 projecting from end wall 16. Spline 68 is in part defined by an interior surface 70 that defines a recess 72 in communication with internal chamber 18. In contrast, first barrier 64 has a groove 74 recessed within end wall 17 to complementarily receive spline 68. Groove 74 also has an interior surface 76 that is in communication with chamber 18 of first barrier 64.

Before ballasting barriers 64 and 66, spline 68 is received with groove 74 to form a snug friction lock between adjacent barriers 64 and 66. Although this is not a positive lock in that barriers 64 and 66 may be separated horizontally, it does distribute loads on impact so that more than one barrier provides resistance to an impact upon barriers 64 and 66. Spline 68 and groove 74 are finished to provide a tight frictional engagement. This may be accomplished by sandblasting the polyethylene after molding or by other methods known in the art. This embodiment is constructed of heavy duty polyethylene, which not only provides rugged strength, but is also semi-rigid. As discussed previously, semi-rigid materials are preferred because of the ability of the material to expand and deform slightly upon ballasting.

This deformation is especially important as the deformation assists in the interlocking of contiguous units. Although the friction fit between spline 60 and groove 74 in the embodiment in FIG. 6A provides some resistance, upon ballasting barrier 66, the ballast causes interior surface 70 of spline 68 to radially expand. In contrast, ballasting internal chamber 18 of barrier 64 pushes on interior surface 76 of groove 74 causing groove 74 to radially constrict. As a result of the expansion of spline 68 and the constriction of groove 74, the interlocking connection between spline 68 and groove 74 is significantly increased.

A variety of different spline 68 and groove 74 configurations can be used in establishing an interlock between opposing end walls 16 and 17. For example, depicted in FIG. 6B is an L-shaped spline 78 projecting from end wall 16 and a complementary L-shaped groove 80 formed on end wall 17 of the adjacent barrier. L-shaped spline 78 and groove 80 operate to create an increased positive engagement between the spline and groove prior to ballasting of barriers 12.

In yet another alternative embodiment, depicted in FIG. 6C is a T-shaped spline 82 and an opposing T-shaped groove 84. In this embodiment, head 86 of T-shaped spline 82 may be slightly larger than mouth 88 of T-shaped groove 84. Accordingly, slight increased force may be required to insert T-shaped spline 82 within T-shaped groove 84. As a result, however, an increased connection force is obtained between the barriers. This force is further increased as the barriers are ballasted causing T-shaped spline 82 to radially expand and T-shaped groove 84 to radially constrict.

Figure 7:
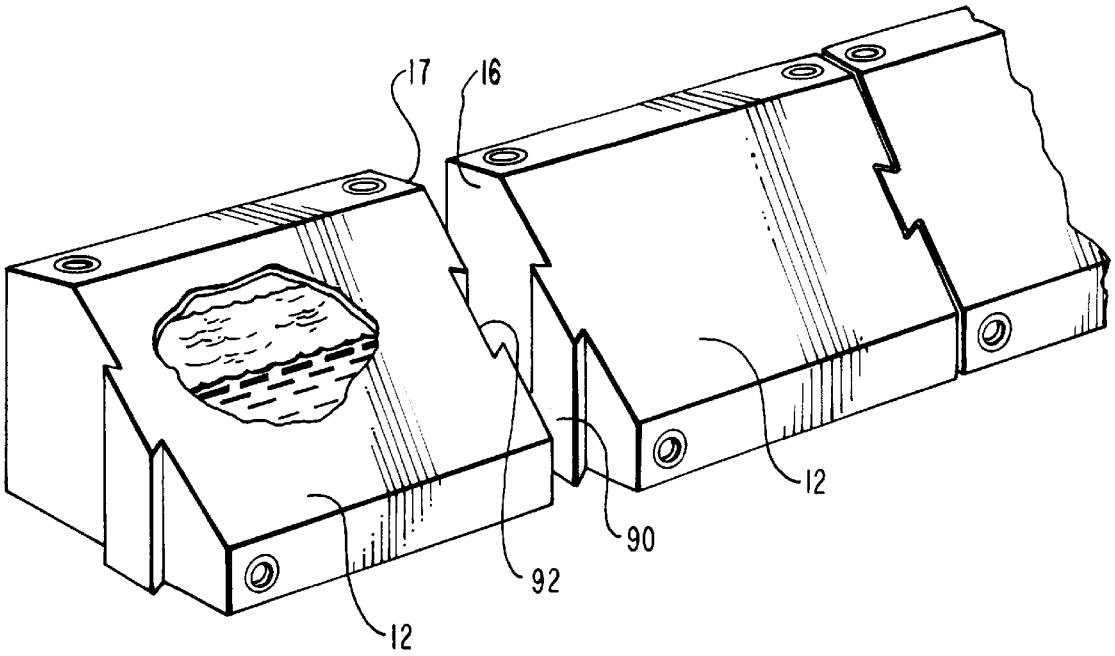
FIG. 7 is a perspective view of adjacent barriers having a dove-tailed shaped spline and groove.

The above discussed spline and groove configurations can be used in either a vertical orientation or a horizontal orientation. For example, as depicted in FIG. 7, dovetailed spline 90 is vertically aligned on end wall 16 and a V-shaped groove 92 is complementarily vertically aligned on end wall 17 of the adjacent barrier 12.

The advantage to this embodiment is that the barriers 12 have a positive lock and cannot be pulled apart horizontally. This is especially beneficial in applications where high pressures are expected to impact the barriers. The disadvantage of the positive lock is that each barrier 12 must be lifted above the level of the previous barrier 12 in order to effect the interlocking engagement. As a result of the positive interlock, however, it may not be desirable to ballast each barrier 12. For applications where a high load is expected, each barrier 12 can be ballasted. In other applications, however, it may be desirable to ballast only every third barrier 12 to take full advantage of the positive interlock of the intervening barriers. In applications where barriers 12 form a curved wall such as when used to surround a temporary ice rink, the positive interlock function of both this dove-tail arrangement and the other interlocking arrangements described herein allow for the use of the barrier wall without any ballasting. The curve of the rink and the positive interlock prevent the barriers from being separated or from being toppled. This provides for a very strong, yet lightweight wall which can be easily moved.

Figure 8:
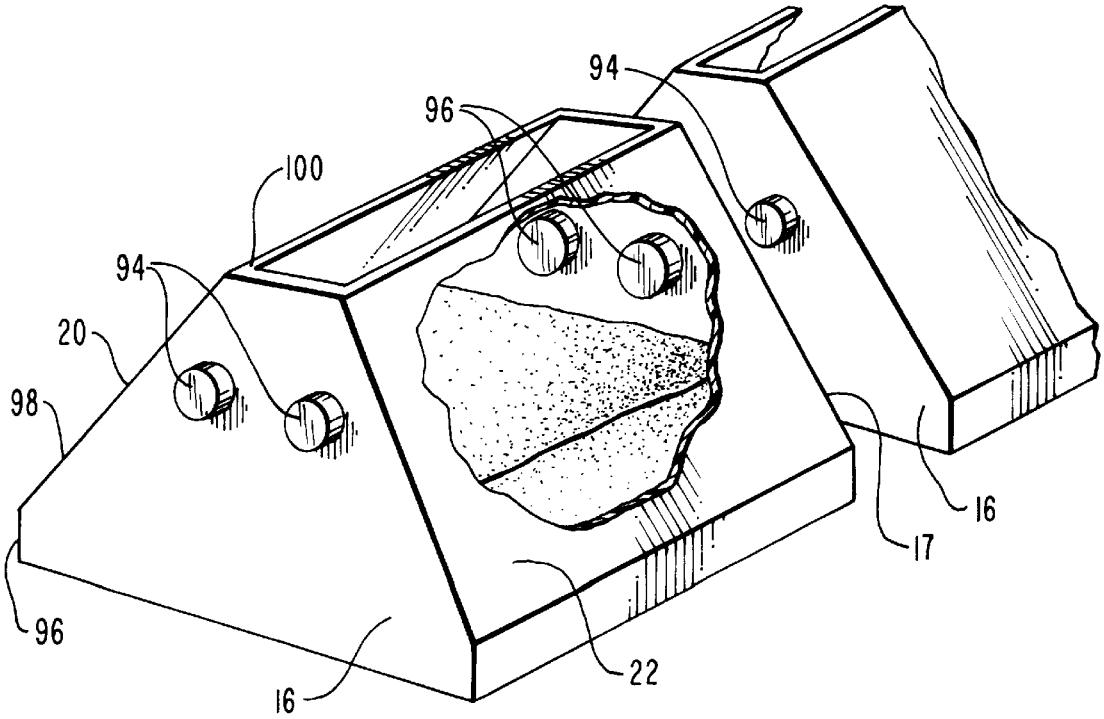
FIG. 8 is perspective view of one embodiment of a pair of adjacent barriers having pegs and corresponding slots positioned on opposing end walls.

Yet another embodiment of the means for mechanically interconnecting adjacent end walls 16 and 17 is illustrated in FIG. 8. In contrast to the previous embodiments where the spline and groove run either vertically or horizontally along end walls 16 and 17, in FIG. 8 the spline comprises a pair of pegs 94 positioned on end wall 16. A pair of grooves 96 having a configuration complementary to pegs 94 are recessed within end wall 17. During use, adjacent end walls 16 and 17 of barriers 12 are merely pressed together so that pegs 94 are received within grooves 96, thereby forming a frictional interlock. As with other embodiments, however, when a ballast is introduced within barriers 12, the semi-rigid material from which barriers 12 are constructed deforms slightly to radially expanding pegs 94 and radially constrict grooves 96, thereby increasing the frictional engagement between barriers 12.

It is noted that barriers 12, depicted in FIG. 8, are an alternative configuration to the barriers 12 previously disclosed in FIGS. 1 and 2. That is, whereas sidewall 20 of barrier 12 in FIG. 1 is substantially vertical, sidewall 20 of the barrier 12 in FIG. 8 comprises a vertical base portion 96 and a sloping portion 98 that extends from base portion 96 to a top portion 100. Sidewall 22 is substantially as disclosed with barrier 12, shown in FIG. 2.

Figure 9:
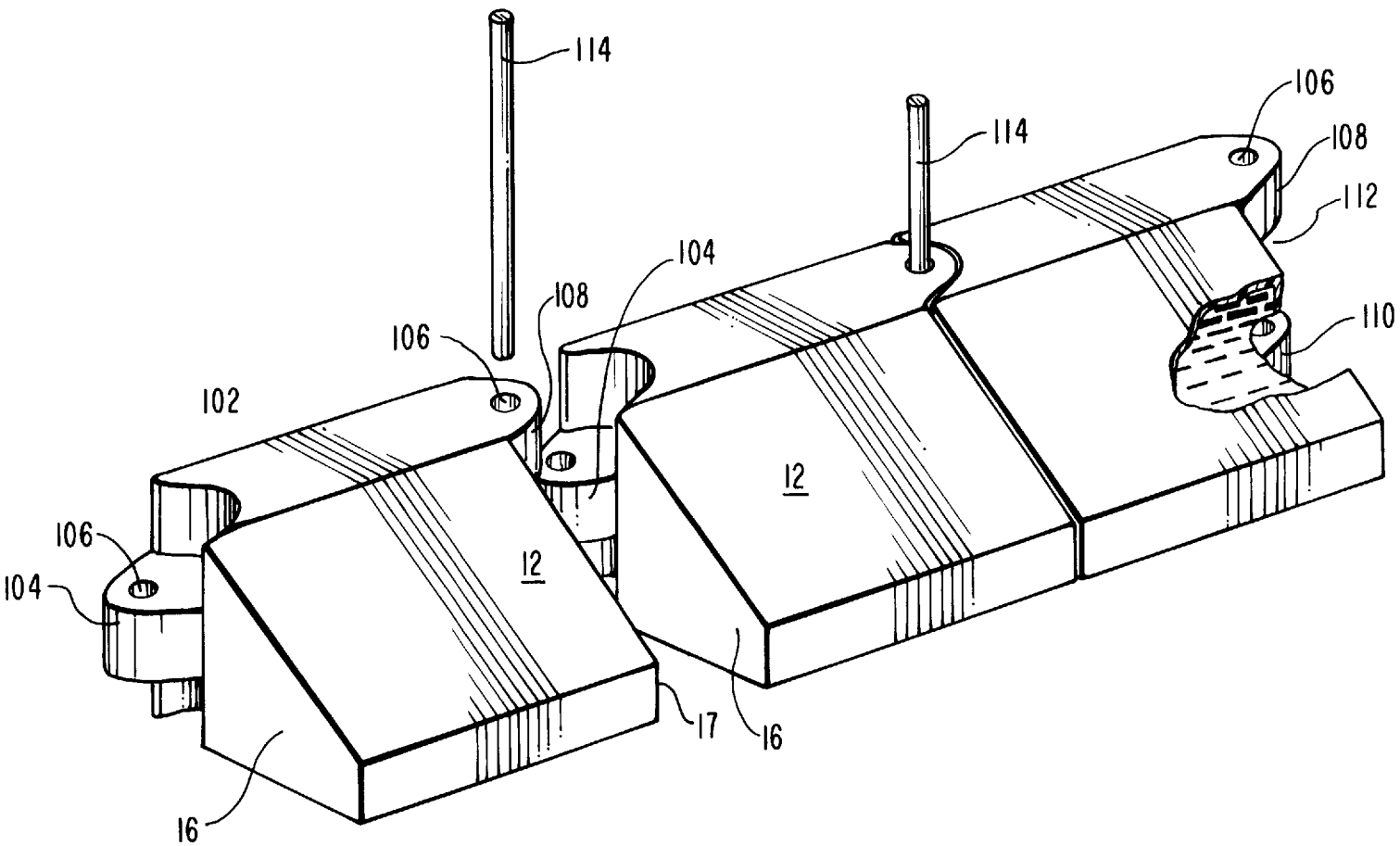
FIG. 9 is a perspective view of alternative embodiments of barriers having structures for rotatably connecting the barriers.

Depicted in FIG. 9 is another structure for interconnecting adjacent end walls 16 and 17 of a pair of barriers 12. As disclosed in FIG. 9, each barrier 12 comprises a vertically elongated channel 102 recessed within end wall 16. Projecting from channel 102 is a middle hinge portion 104 having a channel 106 vertically extending therethrough. Projecting from sidewall 17 is a top hinged portion 108 and a bottom hinged portion 110 each having a channel 106 extending therethrough and being complementarily aligned. Hinged portions 108 and 110 define a recess 112 positioned therebetween and configured to complementarily receive middle hinge portion 104 so that each of channels 106 are complementarily aligned. With hinged portion 104 received between hinged portions 108 and 110, peg 114 can be received through channels 106 to interlock adjacent barriers 12. In this embodiment, adjacent barriers 12 are able to hingedly rotate around the longitudinal axis of peg 114.

Figure 10:
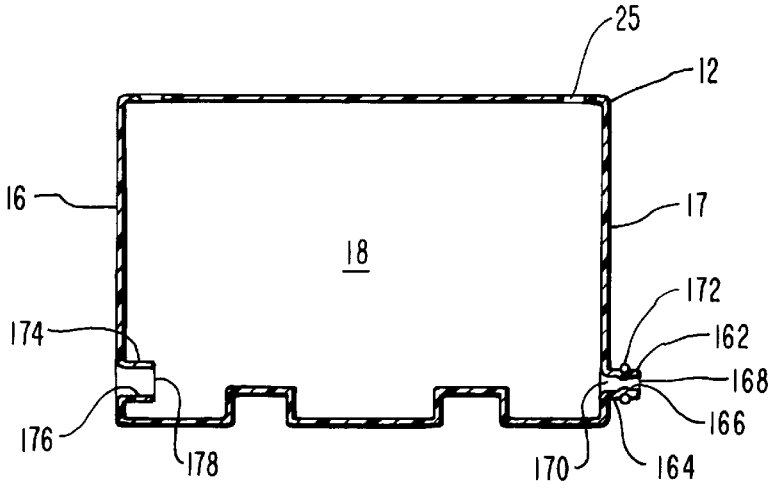
FIG. 10 is a cross-sectional view of a barrier showing a spout and a receiving aperture.

The present invention also provides means for interconnecting in fluid communication end walls 16 and 17 of opposing barriers 12 to enable simultaneously filling with a ballast internal chambers 18 of each of the opposing barriers 12 from one of the barriers 12. By way of example and not by limitation, depicted in FIG. 10 is a longitudinal cross-sectional view of a barrier 12. Projecting from sidewall 17 is an annular spout 162 having an exterior surface 164. Spout 162 extends to an end face 166. End face 166 defines an opening 168 to a channel 170 that extends through spout 162 so as to be in fluid communication with internal chamber 18. Encircling and radially projecting out from exterior surface 164 of spout 162 is a flexible gasket 172.

Formed on opposing end wall 16 is a receiving port 174 having an interior surface 176. Receiving port 174 also has an opening 178 which enables fluid communication between receiving port 174 and internal chamber 18.

Figure 11:
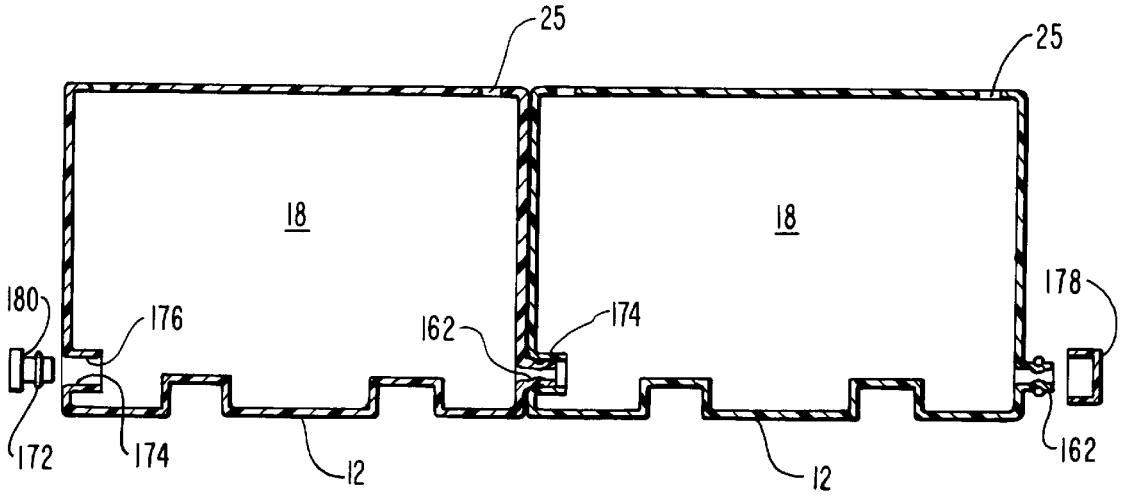
FIG. 11 is a cross-sectional view of a pair or adjacent barriers wherein a spout of one barrier is received within a receiving aperture of an adjacent barrier.

As better depicted in FIG. 11, interior surface 176 of receiving port 174 is sized to snugly receive spout 162 so that gasket 172 effects a sealed fluid communication between spout 162 and receiving port 174. In this embodiment, as internal chamber 18 of one of barriers 12 is filled with ballast through fill hole 25, the ballast, such as water, simultaneously fills the adjacent barrier 12 by passing through spout 162 and receiving port 174. In this way, both barriers 12 are simultaneously filled from one of barriers 12. This becomes especially useful when a plurality of barriers are interconnected to form a wall. Using this embodiment, a water source need only be within reach of a single barrier 12.

As also depicted in FIG. 11, a cap 178 is disclosed for selective attachment to an exposed spout 162. Cap 178 and spout 162 can be attached by threaded engagement. Likewise, a plug 180 can be used for selectively blocking an exposed receiving port 174. Plug 180 can be attached to receiving port 174 by way of frictional engagement between gasket 172 and interior surface 176 of receiving port 174.

The present invention also provides means for affecting a fluid tight seal between receiving port 174 and spout 162 when spout 162 is received within receiving port 174. By way of example and not by limitation, the means for effecting the fluid tight seal includes gasket 172 as discussed above. Furthermore, as a result of the fact that barriers 12 are made of a semi-rigid material, as ballast is received within barriers 12, the mass of the ballast causes spout 162 to radially expand and interior surface 176 of receiving port 174 to constrict. This complementary constricting and expansion results in a tighter seal between spout 162 and receiving port 174.

Figure 12:
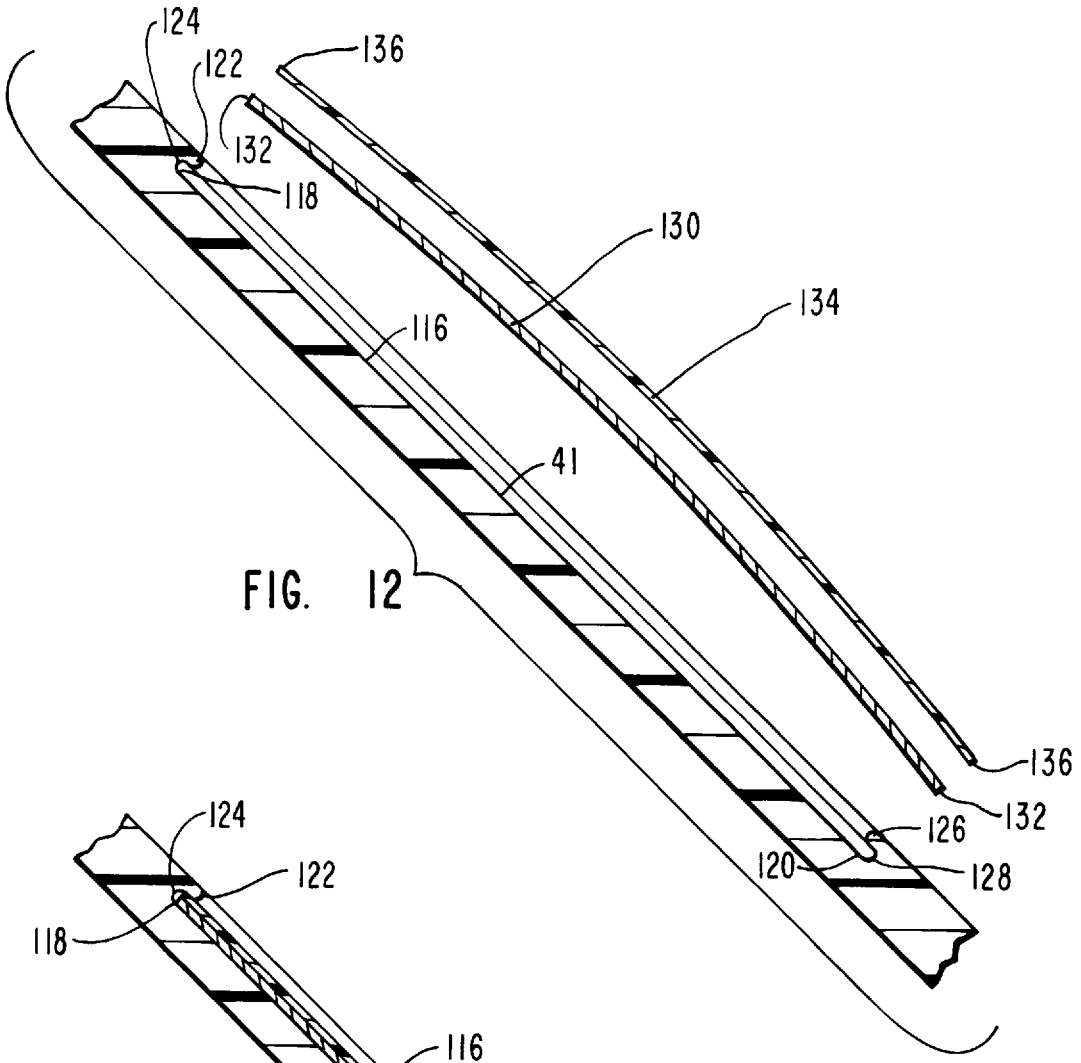
FIG. 12 is a cross-sectional view of a display recess on a barrier.

The present invention also provides means for removably securing an advertising display substantially flush against sidewalls 20 and 22. By way of example and not by limitation, referring back to FIG. 1 is display recess 41 formed on sidewall 22. FIG. 12 shows an enlarged cross-sectional view of recess 41 formed on sidewall 22. As disclosed therein, display recess 41 comprises a display face 116 extending between a top edge 118 and a bottom edge 120. Projecting from top edge 118, a distance toward bottom edge 120 is a first retention lip 122. Retention lip 122 extends so that a slot 124 is formed between retention lip 122 and display face 116. In like manner, a second retention lip 126 projects from bottom edge 120 a distance towards top edge 118. Second retention lip 126 projects so as to define a slot 128 positioned between second retention lip 120 and face 116.

Figure 13:
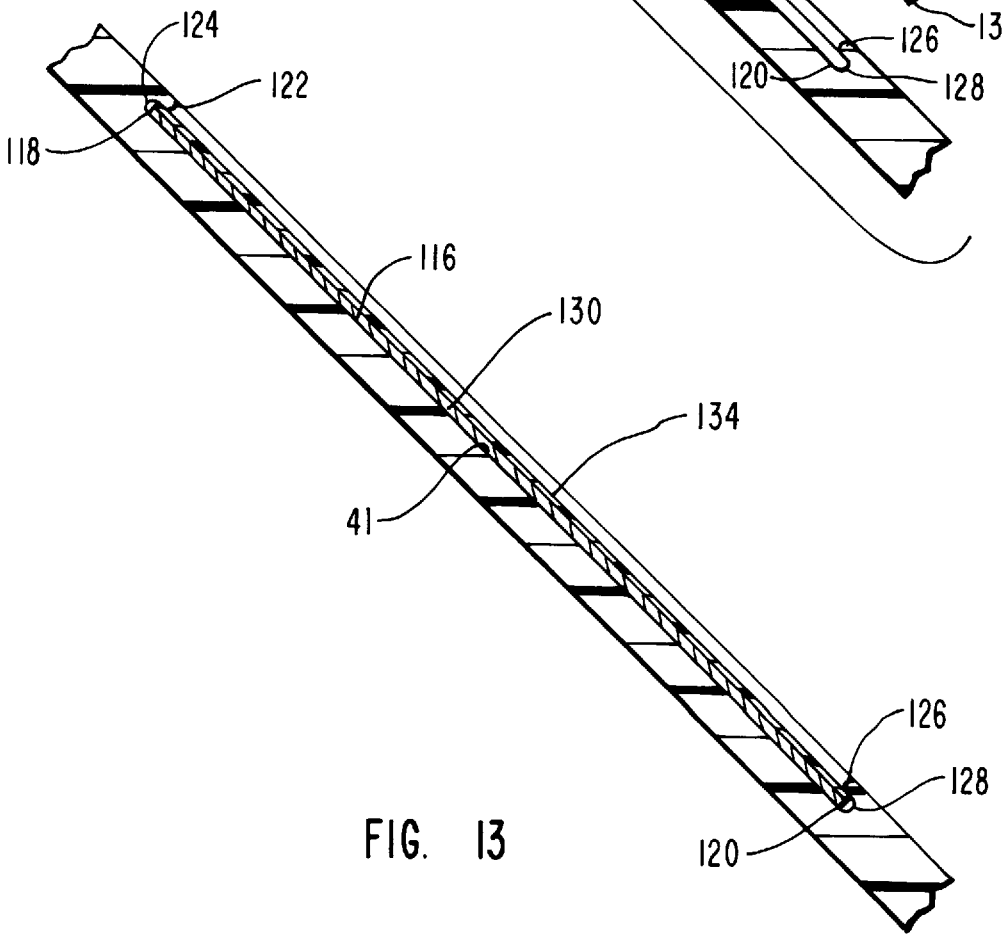
FIG. 13 is a cross-sectional view of the display recess shown in FIG. 12 having a display and a cover received thereon.

As also depicted in FIG. 12, a display 130 is shown. Display 130 is preferably made of paper or thin cardboard and is sized so that when bowed, opposing edges 132 can be positioned flush against face 116. As display 130 is unbowed, edges 132 are complementarily received within slots 124 and 128, as shown in FIG. 13. In one embodiment, a cover 134 can be positioned over the top of display 130 for protecting and securely holding display 130 against display face 116. That is, where display 130 is made from a thin, flexible paper, display 130 may be damaged by rain or be blown off of barrier 12 by wind. Accordingly, cover 134, preferably made of a clear polycarbonate having a thickness of about 1/16 of an inch, can likewise be bowed so that opposing ends 136 can be received within slots 124 and 128.

Cover 134 acts to protect display 130 from rain and, as a result of its increased structural integrity compared to paper, is able to better hold display 130 within display recess 41. To remove cover 134 and display 130, cover 134 is simply bowed so that opposing ends 136 are removed from slots 124 and 128. In an alternative embodiment, display 130 can be made of a flexible vinyl having a thickness of about 1/16 of an inch on which the advertising can be silk screened. In this embodiment, it may not be necessary to use cover 134.

In an alternative embodiment for the means for removably securing the advertising display, the retention lips can be positioned horizontally rather than vertically. That is, retention lips can be positioned adjacent to end walls 16 and 17. In yet another embodiment, one edge of cover 134 can be hingedly connected to barrier 12 while the opposing edge could be bowed to be received within a retention lip.

There are several benefits in using the disclosed structure for attaching the above-discussed advertising display. Most notably, by attaching the advertising display flush against the surface of the barriers, projecting corners and edges are eliminated. As such, the barriers can be used in sporting events and for directing crowds while minimizing the potential injury to an individual who may impact the barriers. Furthermore, the above structure provides easy attachment and removal of the advertising display and provides for prominent disclosure of the advertising display.

Figure 14:
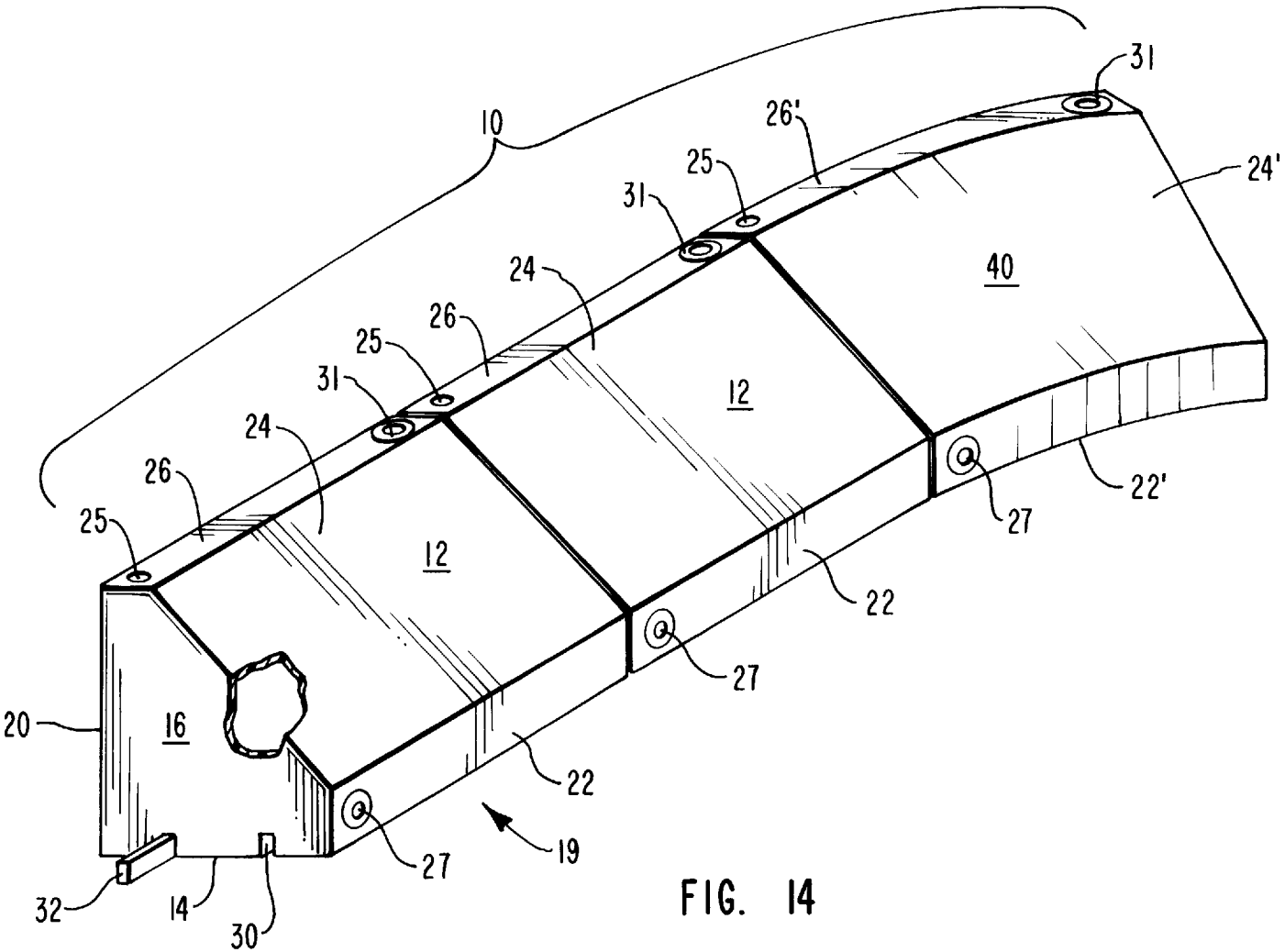
FIG. 14 is a perspective view of a pair of straight barriers attached to a curved barrier.
Figure 15:
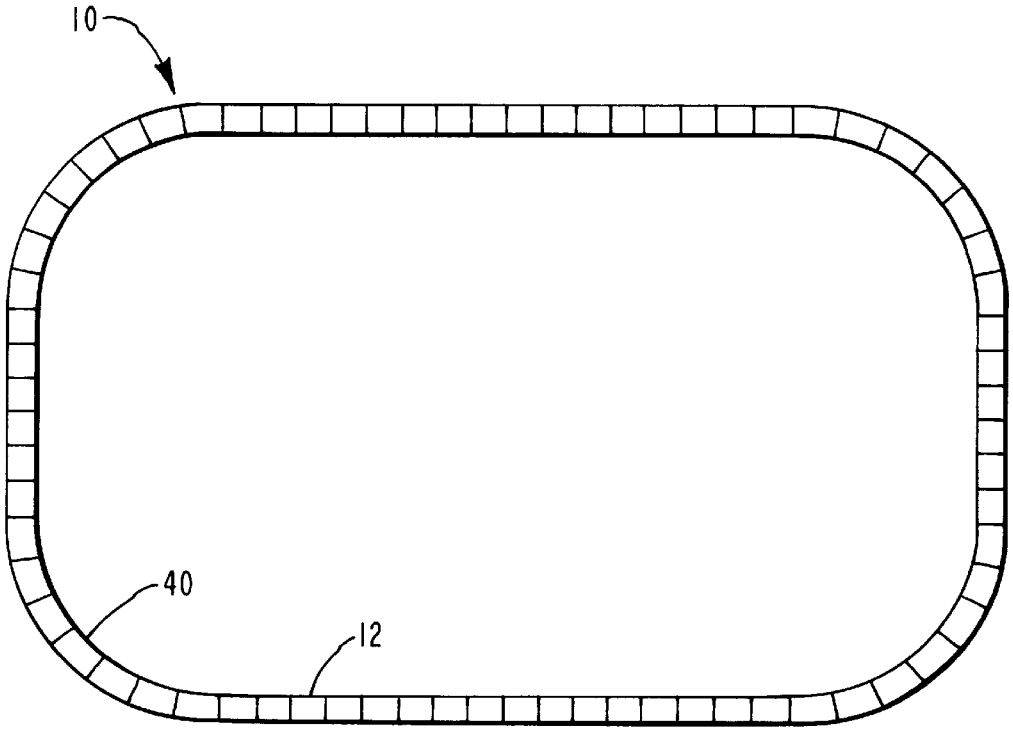
FIG. 15 is a top plan view of a plurality of curved and straight barriers interconnected to form an oval shape.

Although many of the illustrations depict barriers 12 as being straight, it will be appreciated that the shape of an individual barrier 12 can be curved. For example, depicted in FIG. 14 is a straight barrier 12 attached to a curved barrier 40. Although barrier 40 has the same structural elements as barrier 12, barrier 40 is curved along its longitudinal axis. Barrier 40 can be made to have a variety of different angles of curvature to enable the formation of a variety of different shapes. For example, depicted in FIG. 15 is a barrier system 10 comprising a plurality of straight barriers 12 and a plurality of curved barriers 40 secured end to end to form an oval shape. Such an oval shape could be used in the formation of an ice skating rink or soccer playing field. It will be appreciated that many interlockable shapes beyond these illustrated can be created utilizing the principals of the present invention.

Figure 16:
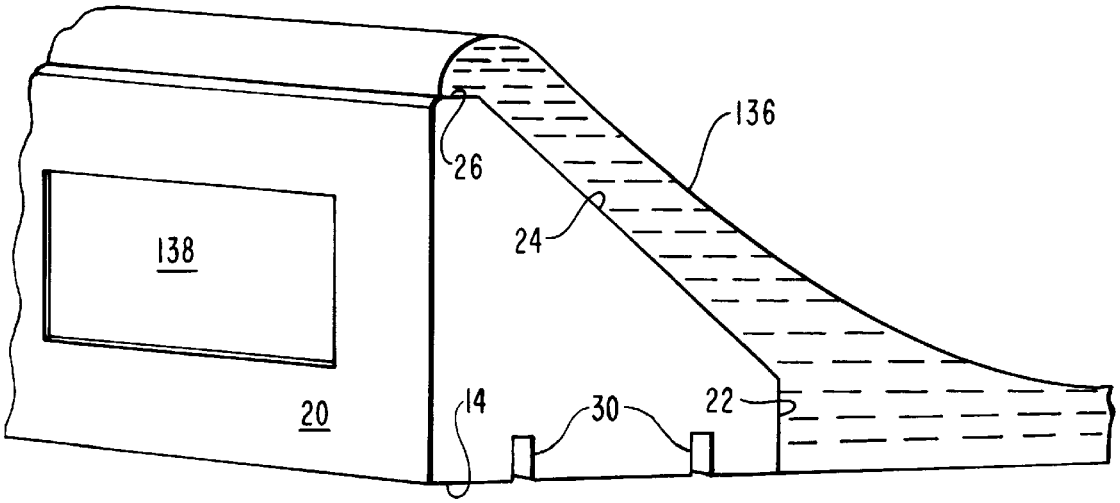
FIG. 16 is a perspective view of a barrier having a display recess.

Referring now to FIG. 16, barrier 10 may be utilized in constructing a half-pipe configuration for use with snowboards, skateboards and the like, whereby snow or an ice surface 136 is placed against the sloping surface of barrier 12 to provide a relatively slick surface to the users. A display recess 138 having the same structural configuration as display recess 41 is shown formed in sidewall 20 of barrier 12. It is thus envisioned that displays can be positioned on both of sidewalls 20 and 22 using substantially the same process as discussed with regard to FIGS. 12 and 13.

An advantage of using polyethylene is that the material provides some cushioning when filled with a water ballast. This cushioning is especially important when the barrier is utilized in athletic events such as hockey where players often impact the barrier. To assist in this cushioning, shredded polystyrene may be included with the water and an antifreeze may be required to maintain the water in a liquid state to preserve the cushioning effect at temperatures below the freezing level of water. Gels may also be utilized.

Figure 17:
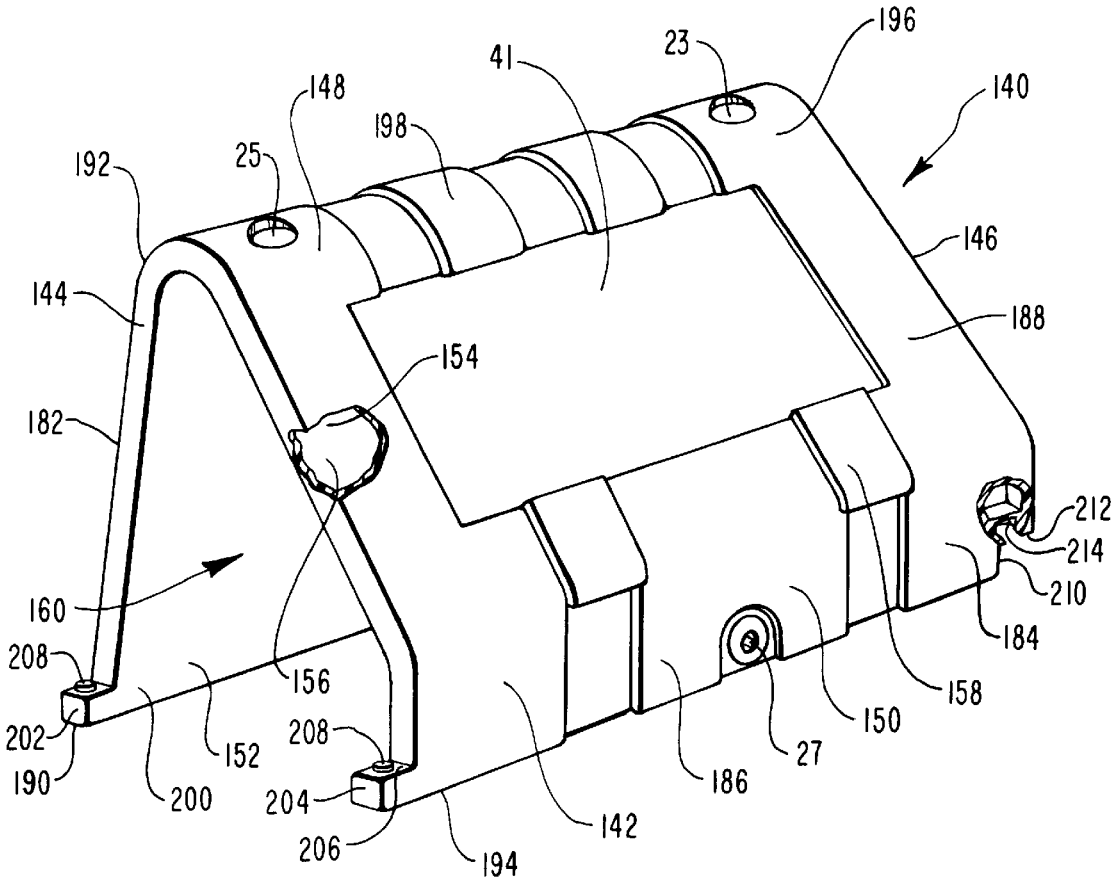
FIG. 17 is a perspective view of an alternative embodiment of a barrier.

Turning now to FIG. 17, an alternative embodiment of a control barrier 140 is disclosed. Barrier 140 comprises an elongated substantially U-shaped housing 142 having opposing substantially U-shaped end walls 144 and 146. Housing 142 further includes an exterior surface 148 including an exposed top surface 150 and a covered bottom surface 152. Housing 142 further includes an interior surface 154 defining an internal chamber 156.

In comparing barrier 140 to barrier 12 disclosed in FIG. 1, exposed top surface 150 comprises opposing sidewalls 182 and 184. Sidewall 182 comprises a bottom edge 190 for resting on a ground surface and an opposing top portion 192. In like manner, sidewall 184 is shown as comprising a bottom edge 194 and a top portion 196. Sidewall 184 further comprises a base portion 186 and a sloping portion 188. Portion 188 slopes radially inward and terminates at a curved top juncture 198 that connects top portion 192 of sidewall 182 and top portion 196 of sidewall 184.

Barrier 140 also includes a bottom wall 200 that extends between bottom edges 190 and 194. In contrast to bottom wall 14 of barrier 12, bottom wall 200 is arched so as to form a passageway 160 extending through housing 142.

Barrier 140 further includes fill holes 23 and 25 which can be used for filling cavity 156 with a ballast or can be used for receiving a support plug 31 having an extending member attached thereto. Drain plug 27 is shown attached to side wall 184 while a complementary drain plug can also be attached to sidewall 182. Furthermore, a display recess 41 is shown on sloping portion 188 and can be used for receiving a display and cover as previously discussed with regard to FIGS. 12 and 13. Support ribs 158 can extend both along sidewalls 20 and 22. Support ribs 158 increase the structural integrity of barrier 140, thereby preventing collapse, and also help to prevent deflection of exposed top surface 150 as ballast is received within internal chamber 156. Minimizing the deflection of top surface 150 helps to prevent any deformation of displays positioned within display recess 41.

The present invention also provides means for mechanically interconnecting end walls 144 and 146 of adjacent barriers 140 so that the strength of the connection increases as internal chamber 156 of barriers 140 are filled with ballast. By way of example and not by limitation, depicted in FIG. 17 is a foot 202 projecting from end wall 144 at bottom edge 190. In like manner, a foot 204 projects from end wall 144 at bottom edge 194. Each foot 202 and 204 is shown as having a top surface 206 with a peg 208 vertically projecting therefrom. In addition, formed on end wall 146 at bottom edges 190 and 194 are a pair of notches 210. Notches 210 are configured to complementarily receive foot 202 and 204 of an adjacent barrier 140.

Furthermore, each notch 210 has a top surface 212 with a slot 214 formed therein. Slot 214 is configured to receive peg 208 when feet 202 and 204 are received within notches 210. In this configuration, opposing end walls 144 and 146 can be selectively interlocked to prevent unwanted separation of barriers 140. As internal chamber 156 is filled with the ballast, top surface 212 of notch 210 compresses against top surface 206 of each foot 202 and 204. As such, the strength of the connection increases as the internal chamber 156 of barriers 140 are filled with ballast. In alternative embodiments, means for mechanically interconnecting end walls 144 and 146 can include the various embodiments such as those previously disclosed with regard to FIGS. 1, 5–8, and 10–11. These alternative embodiments can be used by forming the various structures on end walls 144 and 146.

The configuration of barrier 140 has several advantages. By way of example and not by limitation, as a result of bottom wall 152 being arched to form passageway 160, the volume of internal chamber 156 is significantly reduced. As such, less ballast material is required to fill chamber 156. As a result, less time is required to both fill and remove the ballast material. Furthermore, less ballast is wasted on the ground during draining of barriers 140. Nevertheless, it is envisioned that barriers 140 have a size such that when internal chamber 156 is filled with water, barrier 140 will have a weight of approximately 600 pounds. This weight will be sufficient to prevent unwanted movement of barriers 140.

Figure 18:
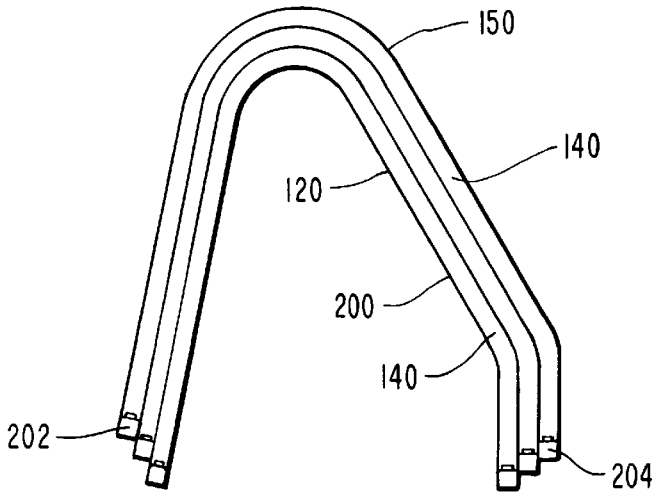
FIG. 18 is a side view of a plurality of the barrier shown in FIG. 17 being nestably stacked.

As depicted in FIG. 18, another advantage of the shape of barriers 140 is that they are nestable. That is, bottom surface 120 of bottom wall 200 is configured complementary to top surface 150 so that bottom surface 120 can nestably receive top surface 150 of an adjacent barrier 140. In this way, a plurality of barriers 140 can be stacked for moving and transport while minimizing the amount of area required.

Barrier 140 is made from substantially the same materials, in substantially the same way, and has substantially the same height, width, and length ranges as discussed with regard to barrier 12.

Figure 19:
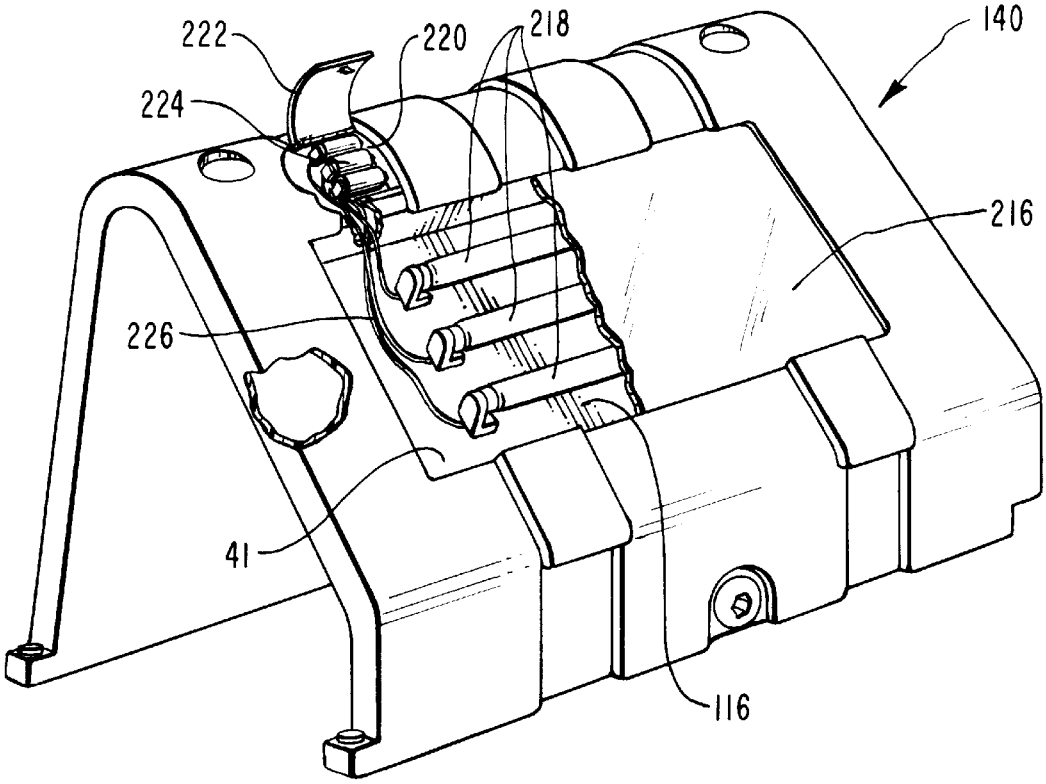
FIG. 19 is a perspective view of an alternative embodiment of the barrier showing FIG. 17 wherein fluorescent light bulbs are used to illuminate a light permeable display.

Shown in FIG. 19 is an alternative embodiment of barrier 140. As depicted therein, a light permeable display 216 is mounted in display recess 41 in substantially the same manner as discussed with regard to FIGS. 12 and 13. The present invention, however, also provides means positioned between the light permeable display 216 and display face 116 for illuminating light permeable display 216.

By way of example and not by limitation, depicted in FIG. 19 are a series of fluorescent bulbs 218 mounted on display face 116. The present invention also provides means for energizing the fluorescent light bulbs 218. As also depicted in FIG. 19, a compartment 220 having a lid 222 is formed in barrier 140. Compartment 220 houses a series of batteries 224 and necessary electrical components that are connected to fluorescent light bulbs 218 by electrical wires 226.

Alternative embodiment for the means for illuminating display 216 include all conventional light filaments. Likewise, alternative means for energizing the various light filaments include conventional battery forms and also electrical wiring which can be connected from an adjacent source of electricity directly to the light filaments.

Figure 20:
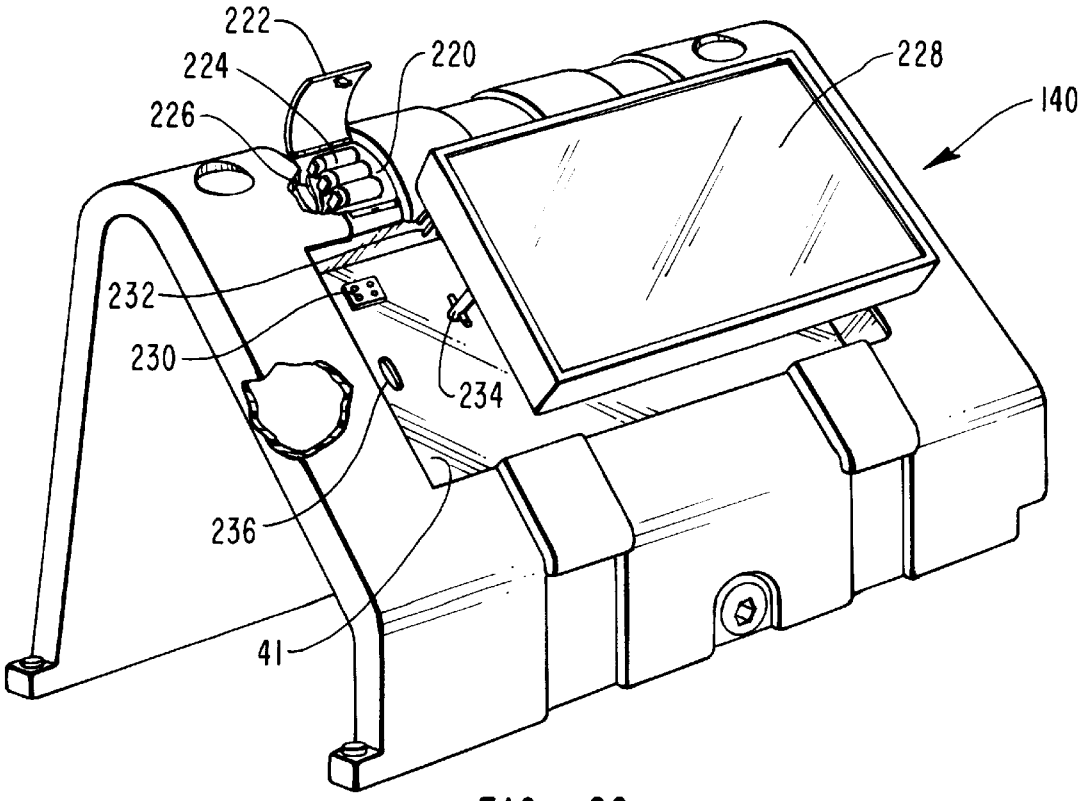
FIG. 20 is a perspective view of an alternative embodiment of the barrier shown in FIG. 17 wherein a programmable LCD display is mounted on the barrier.

Finally, FIG. 20 is yet another alternative embodiment of barrier 140. As disclosed therein, a programmable LCD display 228 is received within display recess 41. Means are also provided for energizing LCD display 228. As depicted in FIG. 20, the means for energizing the LCD display also comprises compartment 220 having batteries 224 contained therein. Batteries 224 are connected by wires 226 to an outlet 230 mounted within display recess 41. Electrical prongs 232 project from LCD display 228 for connection to outlet 230, thereby energizing LCD display 228.

In one embodiment for attaching LCD display 228 to barrier 140, rotatable T-shaped rods 234 project from the back surface of LCD display 228. Complementary receiving slots 236 extend through barrier 140 in display recess 41. By inserting T-shaped rods 234 within slots 236 and rotating T-shaped rods 234, LCD display 228 are secured in place.

Figure 21:
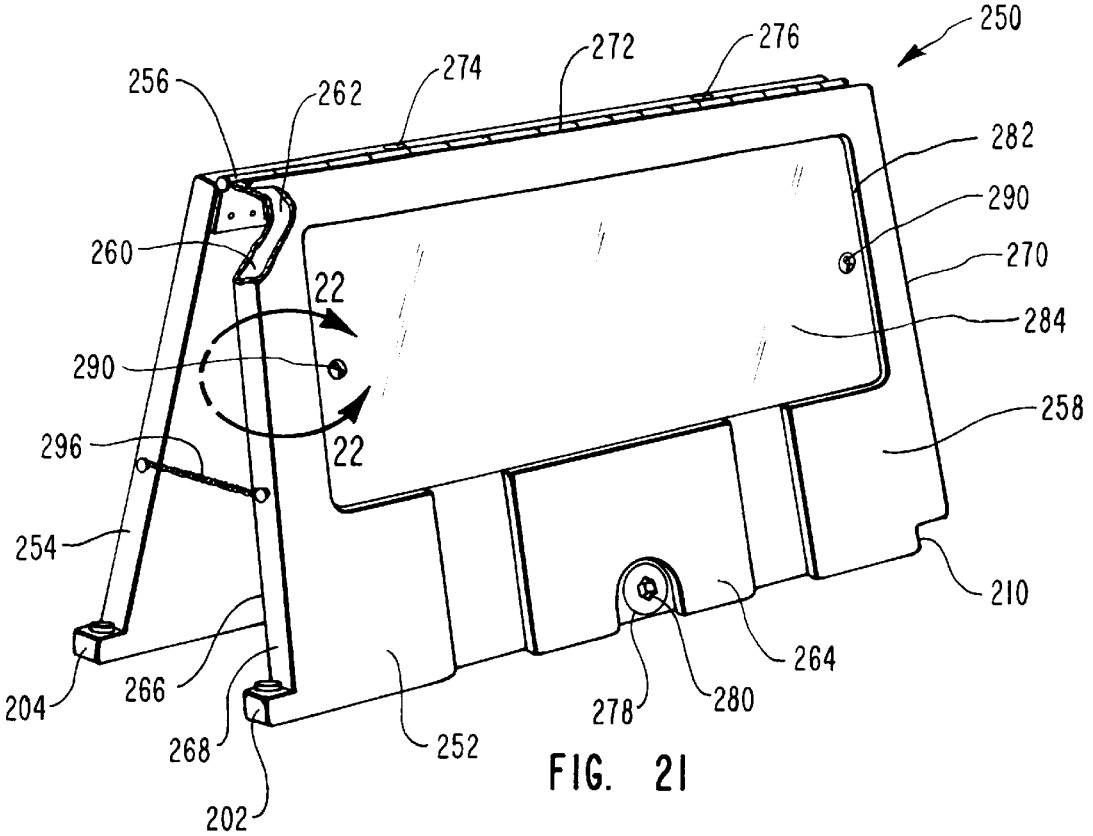
FIG. 21 is a perspective view of an alternative embodiment of a crowd control barrier.

Depicted in FIG. 21 is a collapsible control barrier 250 which is yet another alternative embodiment of the previously disclosed barriers. As depicted therein, control barrier 250 comprises a first wall 252, a second wall 254, and a hinge 256 attached therebetween. First wall 252 and second wall 254 are substantially identical in structural configuration. Accordingly, the following description and reference characters of first wall 254 also apply to second wall 254.

First wall 252 is shown as comprising an exterior surface 258 and an interior surface 260. Interior surface 260 defines an internal chamber 262 that can selectively be filled with a ballast material as previously discussed. First wall 252 is more specifically shown as comprising a front wall 264, a back wall 266, opposing end walls 268 and 270, and a top wall 272. Extending through top wall 272 to communicate with internal chamber 260 are a pair of fill holes 274 and 276. Fill holes 274 and 276 are shown in FIG. 21 as formed on top surface 272 of second wall 254. However, similar fill holes are also configured on first wall 252.

Fill holes 274 and 276 are one embodiment of means for filling internal chamber 262 of each wall 252 and 254 with a ballast. Furthermore, fill holes 274 and 276 can also be used for extending the height of control barrier 250. For example, support plug 31, as previously discussed with FIGS. 1 and 2, can be received within each of fill holes 274 and 276 for receiving structures such as poles 48 and cross member 50 as also previously discussed in FIG. 2.

Control barrier 250 can also be formed with means for draining the ballast from internal chamber 260 of first wall 252 and second wall 254. One embodiment of the draining means includes a drain hole 278 being selectively stopped by a removable drain plug 280.

Figure 22:
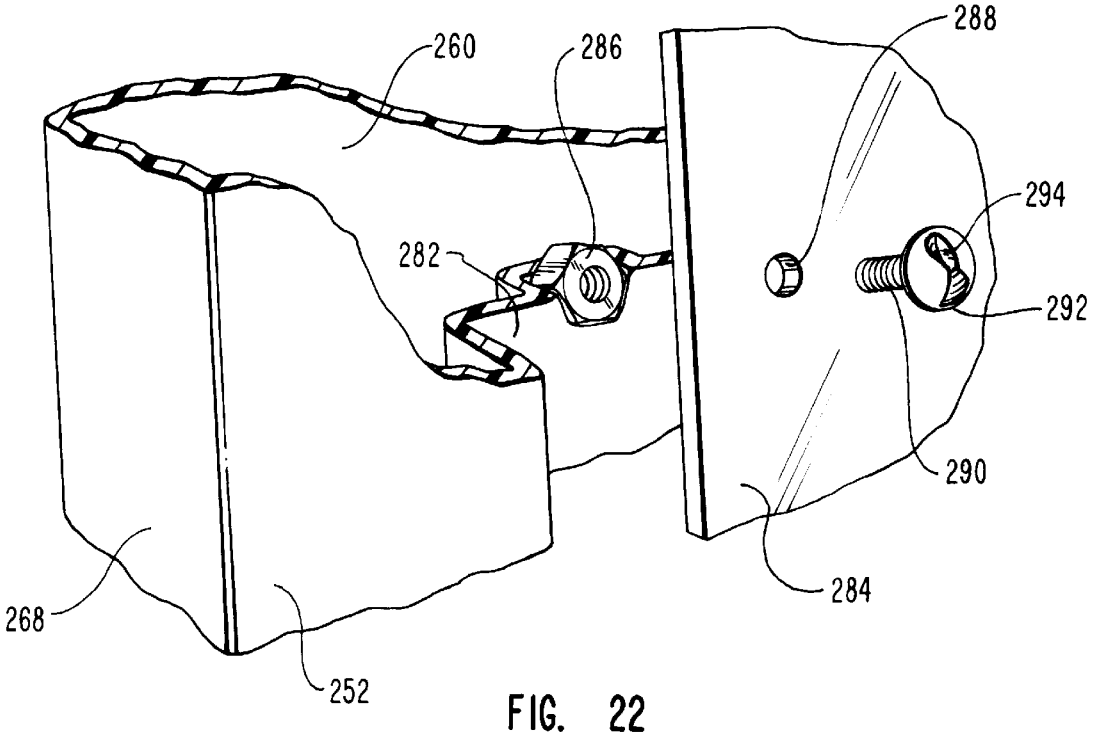
FIG. 22 is an enlarged partially cut away perspective view of the control barrier shown in FIG. 21 taken along section lines 22—22 thereof.

First wall 252 is further shown as having a display recess 282 formed on front wall 264. A display 284 can be mounted within display recess 282 using substantially the same structure and method as previously discusses with FIGS. 12 and 13. Alternatively, as shown in FIG. 22, to attach display 284 to first wall 252 so as to prevent unwanted removal of display 284, first wall 252 can be molded so that a threaded nut 286 is positioned on display recess 282 and securely mounted to first wall 252. An aperture 288 can then be formed on display 284 so as to be aligned with nut 286. Finally, a bolt 290 having a flanged head 292 can be inserted through aperture 288 and threaded within nut 286 so that flanged head 292 securely biases display 284 to first wall 252. As shown in FIG. 21, a plurality of bolts 290 can be used for securely fastening display 284 to first wall 252. As shown in FIG. 22, flanged head 292 preferably has an anti-theft slot 294 formed thereon which permits bolt 290 to be selectively tightened by a conventional screw driver but precludes the bolt 290 from being removed by a conventional screw driver.

The present invention also provides means for mechanically interconnecting end walls 268 and 270 of adjacent barriers 250 so that the strength of the connection increases as internal chamber 260 of barriers 250 are filled with ballast. By way of example and not by limitation, depicted in FIG. 21, is foot 202 projecting from end wall 268 of first wall 252 and foot 204 projecting from end wall 268 of second wall 254. In addition, notch 210 is formed at end wall 270 of each of first wall 252 and 254. Foot 202 and 204 and notches 210 are configured and used in substantially the same fashion as previously discussed with regard to FIG. 17. As such, foot 202 and 204 can be received within notches 210 of adjacent barriers to allow mechanical interconnection therebetween. As the barriers are filled with water, the strength of the interconnection increases. In alternative embodiments, means for mechanically interconnecting end walls 268 and 270 can include the various embodiments such as those previously discussed with regard to FIGS. 1, 5–8, and 10–11. These alternative embodiments can be used by forming the various structures on end walls 268 and 270.

Finally, barrier 250 also includes means for hingedly connecting first wall 252 to second wall 254. One embodiment of the hinging means includes hinge 256 which is secured, such as by adhesive or screws, to each of first wall 252 and 254 near top walls 272 so as to provide a hinge connection between first wall 252 and second wall 254. The present invention envisions that a variety of alternative structures could be used for hingedly connecting barrier walls 252 and 254. For example, first wall 252 and second wall 254 could be molded in an integral fashion so that a thin, flexible material interconnects the two walls allowing hinged rotation therebetween. Alternatively, various types of clothe or flexible materials could be interconnected between first wall 252 and second wall 254 to allow hinged attachment therebetween.

In the preferred embodiment, hinge 256 only opens to a select angle preferably in a range between about 20 to 40 degrees, thereby enabling first wall 252 and second wall 254 to pivotally open around hinge 256 so that control barrier 250 can be positioned in a stable configuration. Furthermore, the fact that hinge 256 only opens a select degree prevents first wall 252 and second wall 254 from opening so far that control barrier 250 no longer extends to the desired height.

As an alternative to having a hinge which only opens to a desired angle, a strap 296 can be used to interconnect end walls 268 and/or end walls 270 to preclude first wall 252 and second wall 254 from pivotally separating at an angle greater than a desired angle. One of the benefits of using strap 296 is that strap 296 can be selectively disconnected from one of end walls 268 or 270 so as to permit first wall 252 and second wall 254 to separate at an angle of 180 degrees so that barriers 250 can be stored by being laid flat.

Barrier 250 is made from substantially the same materials, in substantially the same way, and has substantially the same height, width, and length ranges as discussed with regard to barrier 12. It is also noted, that the lightable display structure and LCD display structure as previously discussed with FIGS. 19 and 20 can also be incorporated into display recess 282 of control barrier 250.

Figure 23:
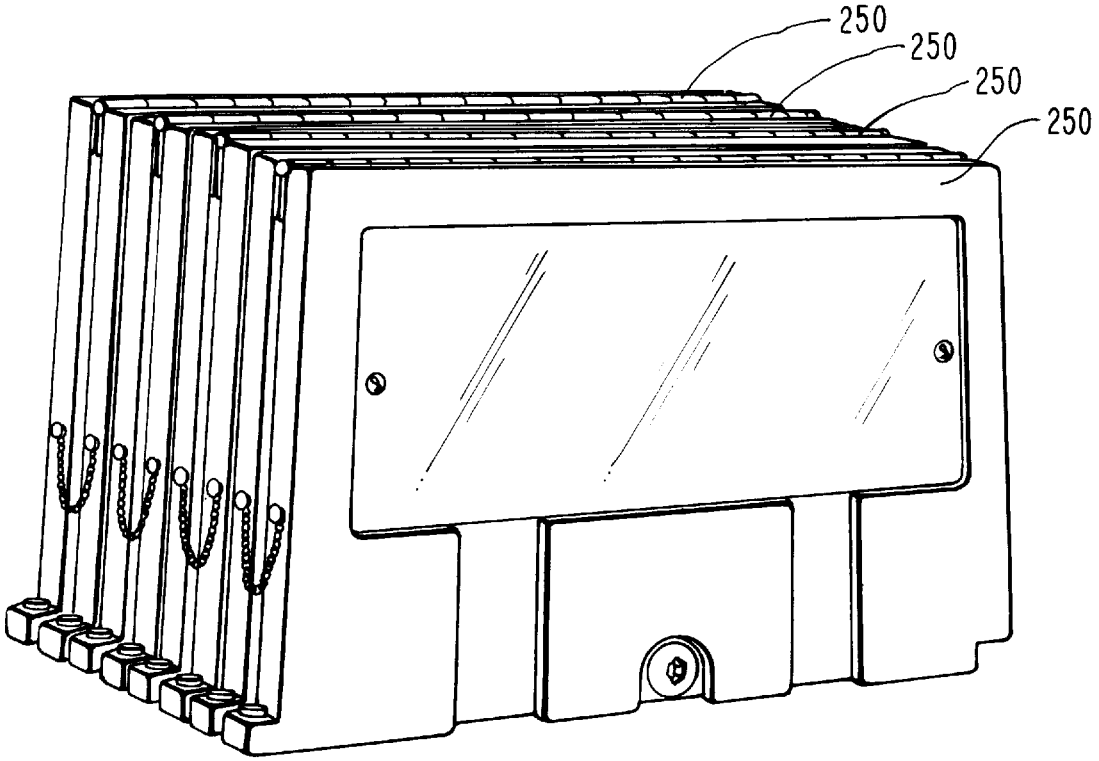
FIG. 23 is a perspective view of a plurality of the control barriers shown in FIG. 22 in a collapsed position.

As depicted in FIG. 23, one of the benefits of barrier 250 is that it can be folded closed into a narrow rectangular configuration that enables a plurality of barriers 250 to be easily carried and stacked for storage. In addition, control barrier 250 has many of the same advantages as the other previously discussed control barrier configurations. Most notably, barrier 250 is easily assembled and removed, can be interconnected with other barriers 250 for forming a continuous wall, and can be easily filled and removed with a ballast to form a secure and stationary barrier.

In summary, because of the unique deformable interlocking structures described in the instant application, a lightweight barrier wall may be constructed to surround any object. By utilizing various shapes, the barrier can be constructed to conform to the outline of a stage, an outdoor athletic event, or even indoor events. After positioning of the units, the units may be ballasted to provide greater resistance to pressure and toppling, however, some embodiments utilize a positive interlock design which does not require ballasting. The non-positive interlocking embodiments, however, utilize an interlocking system which becomes stronger as the unit is ballasted with a liquid or fluid ballast. In areas where water is not available, sand or polystyrene pellets may be utilized. Furthermore, by using the arched shaped barriers, less ballast material is needed. The invention provides for an area on each unit for advertising and provides structures to protect the advertisement from weather. Upon completion of the event, the ballast may be removed from each unit through means for discharging which may comprise a drain hole located near the bottom of the barrier. The barriers may then be disconnected from contiguous units and stacked on a truck and transported to another location and reused.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A control barrier comprising:

(a) a portable housing formed of a resiliently deformable material and having an exterior surface and an interior surface, the interior surface defining an internal chamber, the housing further comprising:

(i) a first sidewall having a bottom edge for resting on a ground surface and an opposing top portion;

(ii) a second sidewall having a bottom edge for resting on a ground surface and an opposing top portion, the top portions of the first sidewall and the second sidewall being connected;

(iii) a bottom wall extending between the bottom edges of the first sidewall and the second sidewall;

(iv) a pair of opposing end walls; and (v) means for interconnecting in fluid communication the end walls of opposing barriers to enable simultaneously filling with a ballast the internal chamber of each of the opposing barriers from one of the barriers;

(b) means for filling the internal chamber with a ballast;

(c) means for draining the ballast from the chamber; and (d) means for removably attaching a display substantially flush against and recessed into one of the sidewalls.

2. A control barrier as recited in claim 1, wherein the means for removably attaching a display comprises a pair of opposing retention lips formed on the exterior surface of one of the sidewalls, the retention lips each projecting to define a slot formed between the retention lip and the exterior surface of the housing.

3. A control barrier as recited in claim 1, wherein the bottom wall is arched so as to define a passageway longitudinally extending through the housing.

4. A control barrier as recited in claim 1, wherein the bottom wall is substantially flat.

5. A control barrier as recited in claim 1, wherein the barrier further comprises:

(a) a pair of opposing end walls; and (b) means for mechanically interconnecting the end walls of adjacent barriers so that the strength of the connection increases as the internal chamber of the barriers are filled with the ballast.

6. A control barrier as recited in claim 1, wherein the housing is formed from a resiliently deformable material.

7. A control barrier as recited in claim 1, further comprising:

(a) a light permeable display mounted on the first side wall of the barrier; and (b) means positioned between the light permeable display and the first side wall of the barrier for illuminating the light permeable display.

8. A control barrier as recited in claim 7, wherein the means for illuminating the light permeable display comprises:

(a) a florescent light bulb recessed within the first side wall of the barrier; and (b) means for energizing the florescent light bulb.

9. A control barrier as recited in claim 1, further comprising:

(a) an LCD display mounted on the first side wall of the barrier; and (b) means for energizing the LCD display.

10. A control barrier configured to hold a thin flexible display having a pair of opposing outside edges, the barrier comprising:

(a) a portable housing having an exterior surface and an interior surface, the interior surface defining an internal chamber, the housing further comprising:

(i) a first sidewall having a bottom edge for resting on a ground surface and an opposing top portion;

(ii) a second sidewall having a bottom edge for resting on a ground surface and an opposing top portion, the top portions of the first sidewall and the second sidewall being connected; and (iii) a bottom wall extending between the bottom edges of the first sidewall and the second sidewall;

(b) a pair of opposing retention lips formed on the first sidewall, each retention lip projecting so as to define a slot formed between the retention lip and the exterior surface of the first sidewall, each slot being recessed within the first sidewall so as to be blocked at each end by the first sidewall, the pair of retention lips being positioned so that as the display is flexed, the pair of opposing outside edges of the display can individually be received within the slots of the pair of retention lips; and (c) means for filling the internal chamber with a ballast.

11. A control barrier as recited in claim 10, wherein the bottom wall is arched so as to define a passageway longitudinally extending through the housing.

12. A control barrier as recited in claim 11, wherein the exterior surface of the first sidewall and the second sidewall have a combined configuration that is substantially complementary to the shape of the bottom wall so that a plurality of barriers can be nestably stacked.

13. A control barrier as recited in claim 10, wherein the bottom wall is substantially flat.

14. A control barrier as recited in claim 10, wherein the barrier further comprises:

(a) a pair of opposing end walls; and (b) means for mechanically interconnecting the end walls of opposing barrier so that the strength of the connection increases as the barriers are filled with the ballast.

15. A control barrier as recited in claim 10, further comprising means for extending the height of the control barrier.

16. A control barrier configured to hold a thin flexible display having a pair of opposing outside edges, the barrier comprising:

(a) an elongated, substantially U-shaped housing, the housing comprising:

(i) an exterior surface including a top surface and a bottom surface, the bottom surface having a configuration substantially complementary to the top surface to enable stacked nesting of a plurality of barriers; and (ii) an interior surface defining an internal chamber;

(iii) a pair of retention lips projecting from the top surface so that each retention lip defines a slot formed between the retention lip and the top surface, each slot being recessed within the top surface so as to be blocked at each end by the top surface, the pair of retention lips being positioned so that as the display is flexed, the pair of opposing outside edges of the display can individually be received within the slots of the pair of retention lips;

(iv) a fill hole communicating with the internal chamber to enable selective filling of the internal chamber with a ballast; and (v) a drain hole communicating with the internal chamber to enable selective draining of the ballast from the internal chamber.

17. A control barrier as recited in claim 16, wherein the barrier has a height in a range between about 3 feet to about 4 feet.

18. A control barrier as recited in claim 16, further comprising a support rib formed on the exterior surface of the housing.

19. A control barrier comprising:

(a) a housing having a first end wall, a second end wall, opposing sidewalls, and an interior surface defining an internal chamber;

(b) means for filling the internal chamber with a ballast; and (c) means for interconnecting in fluid communication the end walls of opposing barriers to enable simultaneously filling with a ballast the internal chamber of each of the opposing barriers from one of the barriers, the means for interconnecting comprising:

(i) a spout having an exterior surface projecting from the first end wall to an end face, the end face defining an opening to a channel extending through the spout so as to be in fluid communication with the internal chamber of the housing; and (ii) a receiving port having an interior surface recessed within the second end wall of the housing, the receiving port being in fluid communication with the internal chamber and being configured to receive the spout of the first end wall of an adjacent barrier.

20. A control barrier as recited in claim 19, further comprising an annular gasket positioned between the receiving port and the spout when the spout is received within the receiving port to effect a fluid tight seal therebetween.

21. A control barrier as recited in claim 19, further comprising means for draining the ballast from the interior chamber.

22. A control barrier as recited in claim 19, wherein the control barrier is formed of a resiliently deformable material.

23. A control barrier as recited in claim 19, further comprising means for extending the height of the barrier.

24. A control barrier as recited in claim 19, further comprising a cap to selectively seal the spout on the barrier.

25. A control barrier as recited in claim 19, further comprising a plug to selectively seal the port on the barrier.

26. A control barrier as recited in claim 19, further comprising means for removably attaching a display substantially flush against one of the sidewalls.

27. A control barrier comprising:

(a) a housing having a first end wall, a second end wall, opposing sidewalls, and an interior surface defining an internal chamber;

(b) a spout having an exterior surface projecting from the first end wall to an end face, the end face defining an opening to a channel extending through the spout so as to be in fluid communication with the internal chamber of the housing;

(c) a receiving port having an interior surface recessed within the second end wall of the housing, the receiving port being in fluid communication with the internal chamber and being configured to receiving the spout on the first end wall of an adjacent barrier;

(d) means for effecting a fluid tight seal between the receiving port and the spout when the spout is received within the receiving port; and (e) means for filling the internal chamber with a ballast.

28. A control barrier as recited in claim 27, wherein the means for affecting a fluid tight seal comprises a gasket positioned between the spout and the receiving port when the spout is received within the receiving port.

29. A control barrier as recited in claim 27, further comprising means for draining the ballast material from the internal chamber.

30. A control barrier as recited in claim 27, further comprising means for removably attaching a display substantially flush against one of the sidewalls.

31. A control barrier comprising:

(a) a first wall having an exterior surface and an interior surface, the interior surface defining an internal chamber;

(b) means for filling the internal chamber of the first wall with a ballast;

(c) a second wall having an exterior surface and an interior surface, the interior surface defining an internal chamber;

(d) means for hingedly connecting the first wall to the second wall; and (e) means for mechanically interconnecting first walls of adjacent control barriers so that the strength of the connection increases as the first walls are filled with the ballast.

32. A control barrier as recited in claim 31, further comprising means for extending the height of the first wall.

33. A control barrier as recited in claim 31, further comprising means for removably attaching a display substantially flush against the exterior surface of the first wall.

34. A control barrier as recited in claim 31, further comprising means for draining the ballast from the internal chamber of the first wall.

35. A control barrier as recited in claim 34, wherein the means for draining comprises:

(a) a drain hole extending through the exterior surface and communicating with the internal chamber of the first wall; and (b) a cap for selectively sealing off the drain hole.

36. A control barrier as recited in claim 31, wherein the means for mechanically interconnecting adjacent control barriers comprises each of the first walls having:

(a) a first end wall (b) a foot projecting from the first end wall;

(c) a second end wall;

(d) a notch formed on the second end wall, the notch being formed to receive the foot from the first end wall of an adjacent barrier; and (e) means for locking the foot within the notch.

37. A control barrier as recited in claim 31, further comprising:

(a) a light permeable display mounted on the exterior surface of the first wall; and (b) means positioned between the light permeable display and the first wall for illuminating the light permeable display.

38. A control barrier as recited in claim 31, further comprising:

(a) an LCD display mounted on the top surface of the barrier; and (b) means for energizing the LCD display.

39. A control barrier comprising:

(a) a portable housing formed a resiliently deformable material and having an exterior surface and an interior surface, the interior surface defining an internal chamber, the housing further comprising:

(i) a first sidewall having a bottom edge for resting on a ground surface and an opposing top portion;

(ii) a second sidewall having a bottom edge for resting on a ground surface and an opposing top portion, the top portions of the first sidewall and the second sidewall being connected; and (iii) a bottom wall extending between the bottom edges of the first sidewall and the second sidewall;

(b) means for filling the internal chamber with a ballast;

(c) means for draining the ballast from the chamber;

(d) means for removably attaching a display substantially flush against one of the sidewalls;

(e) a pair of opposing end walls; and (f) means for interconnecting in fluid communication the end walls of opposing barriers to enable simultaneously filling with a ballast the internal chamber of each of the opposing barriers from one of the barriers.

40. A control barrier comprising:

(a) a housing having an exterior surface extending between opposing end walls and an interior surface defining an internal chamber, the exterior surface comprising:

(i) an exposed top surface; and (ii) a covered bottom surface, the bottom surface being substantially U-shaped and defining a passageway extending between the opposing end walls; and (b) means for filling the internal chamber with a ballast; and (c) means for mechanically interconnecting adjacent barriers so that the strength of the connection increases as the barriers are filled with the ballast.

41. A control barrier as recited in claim 40, wherein the means for mechanically interconnecting adjacent barriers comprises each of the barriers having:

(a) a U-shaped first end wall (b) a foot projecting from the first end wall;

(c) a U-shaped second end wall;

(d) a notch formed on the second end wall, the notch being formed to receive the foot from the first end wall of an adjacent barrier; and (e) means for locking the foot within the notch.

* * * * *